US007409789B1

(12) United States Patent
Lang

(10) Patent No.: US 7,409,789 B1
(45) Date of Patent: Aug. 12, 2008

(54) SIGN SUPPORT

(76) Inventor: Paul A. Lang, 5917 Ashcroft Ave., Edina, MN (US) 55424

( * ) Notice: Subject to any disclaimer, the term of this patent is extended or adjusted under 35 U.S.C. 154(b) by 52 days.

(21) Appl. No.: 11/368,018

(22) Filed: Mar. 3, 2006

Related U.S. Application Data

(62) Division of application No. 10/183,209, filed on Jun. 26, 2002, now Pat. No. 7,007,419.

(51) Int. Cl.
*G09F 15/00* (2006.01)

(52) U.S. Cl. ..... 40/606.01; 40/606.14; 40/607.04; 40/612; 248/125.8; 116/63 P

(58) Field of Classification Search ..... 40/606.01, 40/606.14, 607.04, 607.1, 612, 584; 116/63 P; 404/9, 10; 248/125.8, 125.1, 121
See application file for complete search history.

(56) References Cited

U.S. PATENT DOCUMENTS 614,432 A * 11/1898 Austin ..... 211/5
1,635,394 A * 7/1927 Anderson ..... 40/607.1
2,540,169 A * 2/1951 Kanaval ..... 403/378
3,798,814 A * 3/1974 Harmon ..... 40/590
4,137,662 A * 2/1979 Baumer ..... 40/612
4,325,197 A * 4/1982 Achten et al. ..... 40/610
5,094,023 A * 3/1992 McVey ..... 40/607.04
2002/0088157 A1 * 7/2002 Winterton et al. ..... 40/610

* cited by examiner

*Primary Examiner*—Gary C Hoge
(74) *Attorney, Agent, or Firm*—Richard John Bartz

(57) ABSTRACT

A pair of sign support frames connected to a sign with upright member has upright reinforcement bars secured to arch or base members. The bars are associated with the upright members to reinforce the upright and arch members in motor vehicle impact areas above the arch members. When the upright members are hit with a motor vehicle the sign support frames move upwardly and rearwardly into engagement with the bumper or front frame of the motor vehicle to limit rearward movement of the sign toward the motor vehicle and reduce bending and breaking forces on the upright members and sign support frames.

11 Claims, 27 Drawing Sheets

SIGN SUPPORT

CROSS REFERENCE TO RELATED APPLICATION

This application is a division of U.S. application Ser. No. 10/183,209 filed Jun. 26, 2002 now U.S. Pat. No. 7,007,419.

FIELD OF THE INVENTION

The invention relates to stands and support frames for display and warning signs used temporarily in connection with road construction or repair, temporary hazardous driving conditions, and protection of workpersons and survey crews. More particularly, the invention is directed to signs and sign support frames that have components that are designed when hit with an automobile not to penetrate an automobile person's compartment through the windshield or floorboards.

BACKGROUND OF THE INVENTION

Conventional sign supports for retaining signs in viewing positions along roads and highways comprise stationary posts and frames attached to the road shoulder or ground adjacent the road and portable sign supports. Portable sign supports include foldable A frames and inverted T frames. The conventional inverted T frame sign support has a pair of frames connected to perforated upright members. Plywood or aluminum work zone or road condition signs are fastened with bolts to the upright members. Each frame has a horizontal leg member and an upright stud or receiver secured to the center of the leg member. The studs are short having a height of no more than 12 inches. A small section of the upright member telescoped over the stud is attached to the stud with a reasonable connection. The upright member and stud are separable to facilitate handling, storage, and transport. The stud is located below the automobile impact area on the upright member. When the upright members are hit with an automobile, substantial impact forms on the upright members bend and break the studs from the horizontal members and bend, break and fragmentize the upright member. The separated parts of the sign and support frame can penetrate the windshield of the automobile or enter the bottom of the driving compartment which can cause injury to persons and property.

United States Transportation Equity Act, Public Law 105-178, requires mandatory compliance with sign safety guidelines. All highway appurtances and devices, including signs, guard rails, barricades, and traffic cones, to be tested for crashworthiness. The test involves crashing a small automobile into each device at 100 km/hour. A device is considered safe or crashworthy if none of its components penetrate in the test automobile's passenger compartment via the windshield or up through the floorboards. The automobile must also remain on its pre-crash trajectory and no experience unnecessary deceleration. A number of tests have been conducted on the conventional sign and sign support to ascertain crashworthy structures. The results of these tests have not been favorable. The portable sign systems often found crashworthy are those that display flexible rollup traffic signs. W. A. Werner in U.S. Pat. No. 4,951,407 discloses a yieldable sign stand. There is a high cost of converting entire inventories of connected sign systems over to rollup sign systems. Sign systems have been proposed with structures that break away at their base or horizontal member with the intent of allowing the sign and a portion of the upright members to pass over the automobile. The type of controlled fracture structure tends to direct the sign into the windshield of the automobile or send the sign spinning into on-coming traffic.

SUMMARY OF THE INVENTION

The invention is directed to portable sign support frames for displaying standard plywood, metal or plastic signs continuing visual warning, regulatory and informational wording or designs. The sign support frames have right members that are reinforced and connected together to hold together during an automobile crash test and an actual road crash. The sign support frames had cooperating upright members and rigid bars that have sufficient structural strength to prevent the sign and members attached to the sign from being pulled down into the windshield of an automobile upon initial impact and prevent the sign frame from penetrating the floor boards and entering the passenger compartment of the automobile. The small structures of the sign support frame, upright member and sign experience only minor distortions when impacted with an automobile so that they cooperate and work together to overcome, the aerodynamic drag forces that force the sign downward toward the windshield of the automobile after being hit by the automobile. The sign support frames have rigid reinforcing bars coupled to the upright members to prevent impact related fracturing, shearing, bending and fragmentation of the frames and upright members connecting the frame to signs. Additional structural reinforcements can be added to the frame in the automobile impact area. These reinforcements include sleeves, channel and angle members connected to the upright members. In one embodiment of the sign support frame, an upward arch member is used to reduce the vertical spacing between the impacting automobile bottom of the bumper or front frame to limit the rise and tilt of the frame and upright support during an impact. The automobile bumper in engagement with the frame limits rearward and upward movements of the frame which reduces the bending and breaking focus on the bar, connection of the bar to the arch member and upright member. After the sign and sign support frame has accelerated to the automobile speed, the flat sign functions as an air foil that forces the sign and sign support frame downward.

One embodiment of the combined sign and sign support assembly has a pair of sign support frames coupled to upright members that are connected to a sign. The sign is a rigid panel of plywood or metal having road condition and drawing information. Each of the sign support frames have an upwardly directed arch member having surface engaging feet at their outer ends. The arch member has a convex curved shape or downwardly and outwardly directed legs. The legs are joined at the order ends to feet having upwardly and outwardly inclined toes or surfaces. The toes can be crushed formal tips that prevent the fat from digging into the road and helps the feet to glide over sod, gravel and cracks in the road surface. The top surfaces of the feet serves as location for sand bag ballast. An upright rigid bar is secured to a central section or bridge of the arch member. A rigid weld connects the bar to the arch member. Gussets and plates and fasteners can also be used to firmly connect the bar to the arch member. The connection of the bar to the arch member has sufficient holding and shear strength to prevent breakaway or separation during the acceleration of the sign and sign support assembly due to the impact of an automobile on the sign support assembly. The bar has a vertical height from the push member extended above the automobile bumper impact area on the frame assembly. The upright member has a lower portion telescoped over the bar and secured them with a releasable fastener. The fastener allows the vertical height of the upright member to be adjusted to change the elevation of the sign attached thereto. The lower portion of the upright member and bar can be further reinforced with a rigid sleeve position around the lower portion of the upright member or other reinforcing structure, such as channel and angle members. The arch member has upper portions that engage the bottom of the automobile bumper or front frame when the frame assembly is hit by the automobile. The arch member is centered with the bumper or front frame of the vehicle limit lifting and telling of the frame assembly and sign. This prevents the sign from penetrating the windshield of the automobiles and reduces bending and breaking forces on the bar and connection of the bar to the arch member.

Another embodiment of the sign support frame for a sign has a frame having two pairs of outwardly diverging legs joined to a receiver accommodating an upwardly directed reinforcement bar. A single upright member telescoped over the bar extends upwardly adjacent a sign. Fasteners connect sign to the upright member and the bar to the receiver. The bar has a vertical height above the impact area on the upright member of a motor vehicle hitting the upright member. The center of gravity of the sign support frame is at or below the impact area on the upright member. The impact force of the motor vehicle hitting the upright member reinforced with the bar above the center of gravity of the support frame reduces the rearward force of the upper portion of the upright member and sign attached thereto. This force reduction inhibits bending and breaking of the upright member and breaking of the cormection of the bar to the receiver.

DESCRIPTION OF EMBODIMENTS OF THE INVENTION

Figure 1:
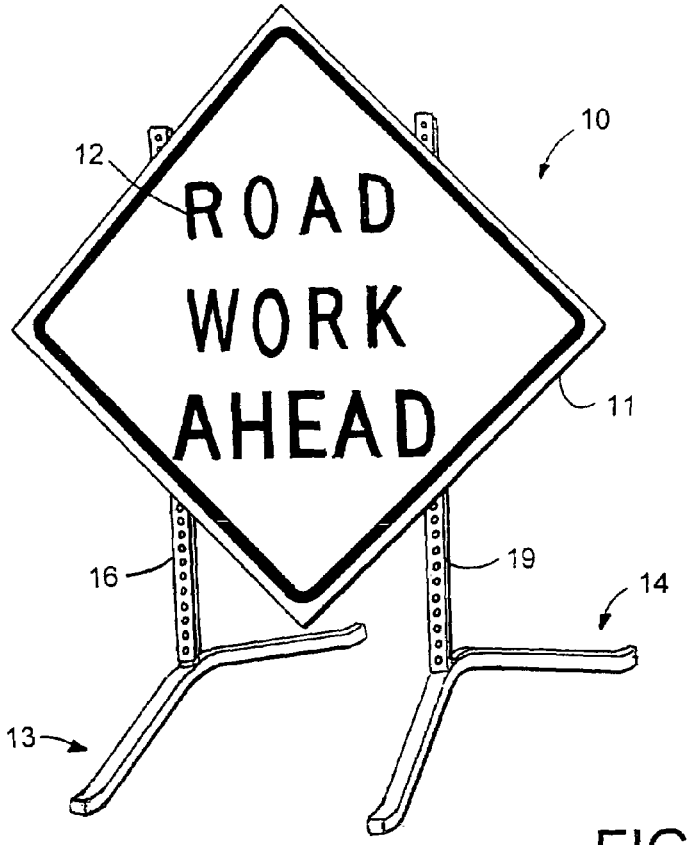
FIG. 1 is a perspective view of a highway sign attached to a pair of sign support frames.
Figure 2:
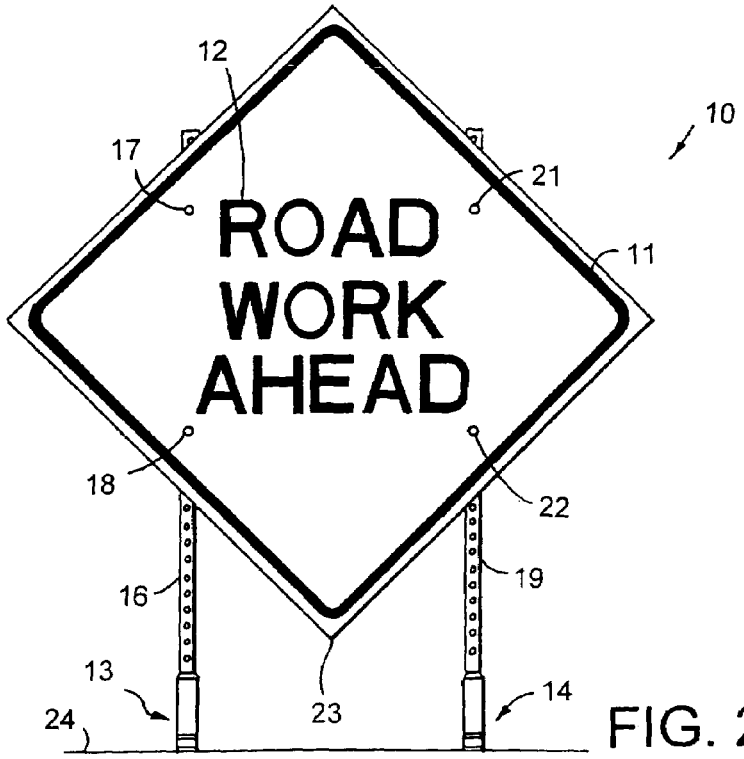
FIG. 2 is a front elevational view of the highway sign and sign support frames of FIG. 1.
Figure 3:
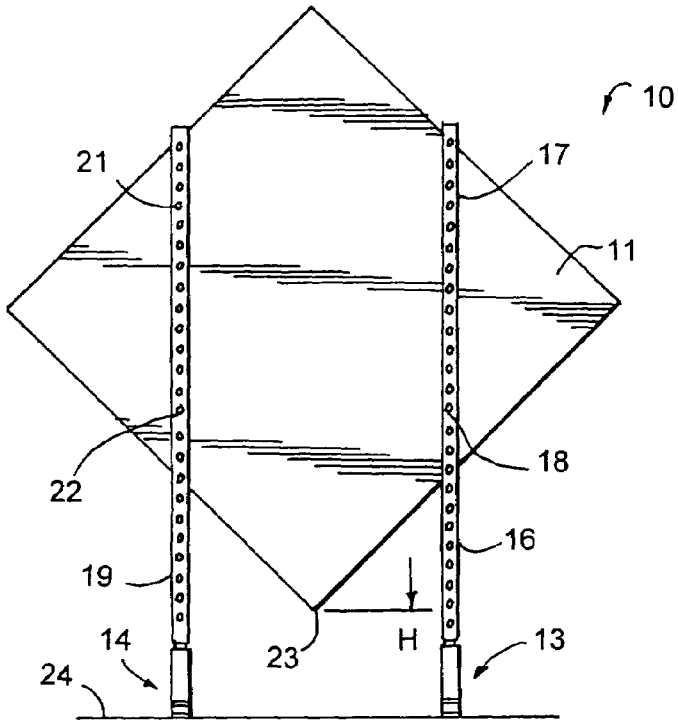
FIG. 3 is a rear elevational view of the highway sign and sign support frames of FIG. 1.
Figure 4:
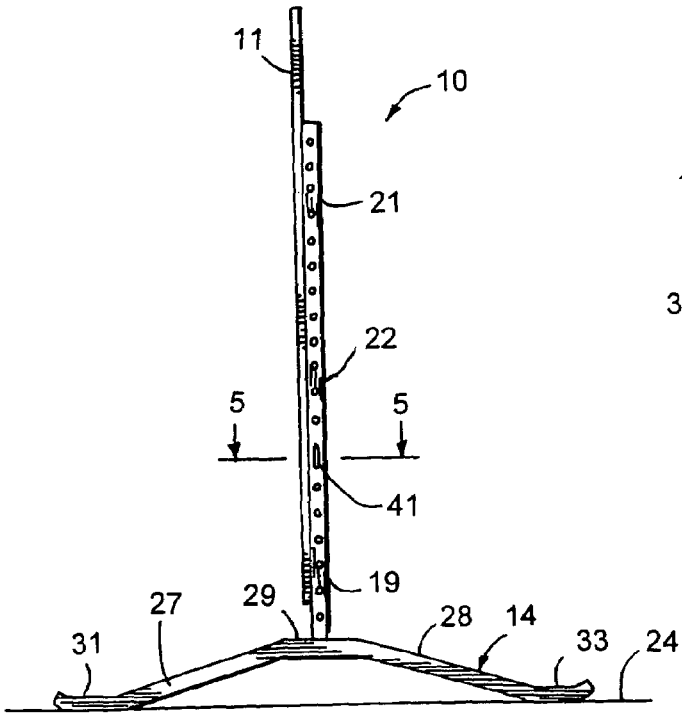
FIG. 4 is a side elevational view of the highway sign and sign support frame of FIG. 1.
Figure 5:
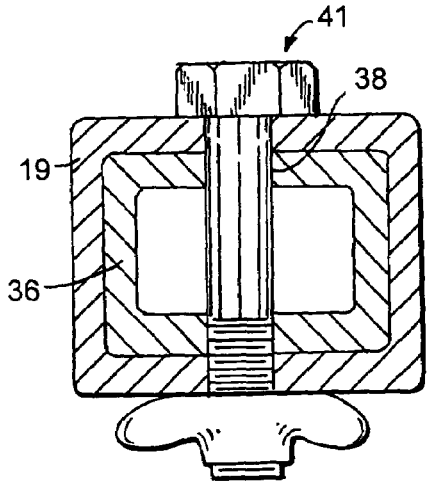
FIG. 5 is an enlarged sectional view taken along line 5-5 of FIG. 4.
Figure 6:
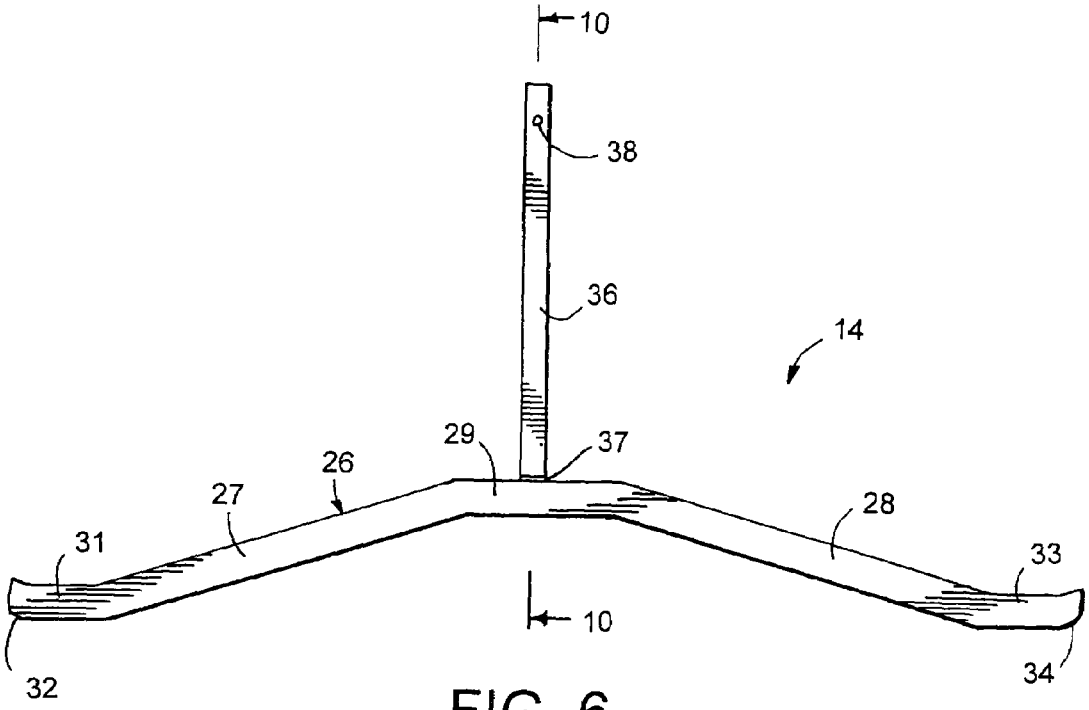
FIG. 6 is a side elevational view of the arch member and upright bar of a sign support frame.
Figure 7:
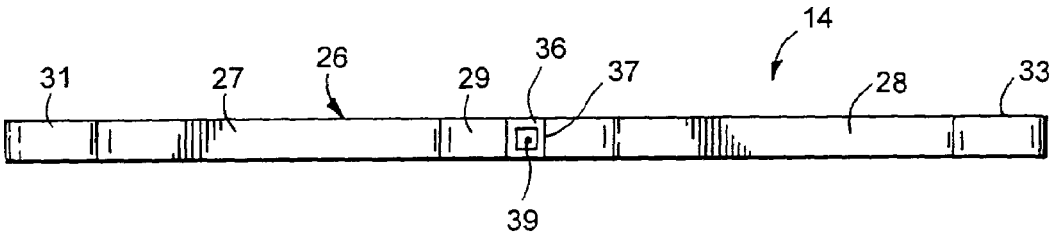
FIG. 7 is a top plan view of the arch member and upright reinforcement bar of FIG. 6.
Figure 8:
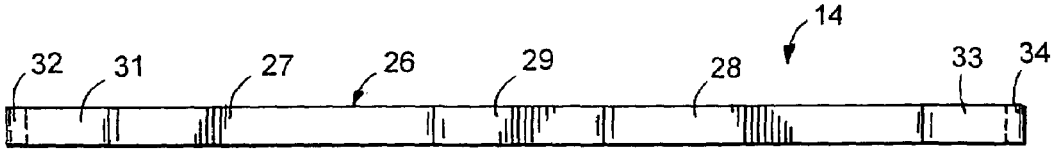
FIG. 8 is a bottom plan view of the arch member and upright bar of FIG. 6.
Figure 9:
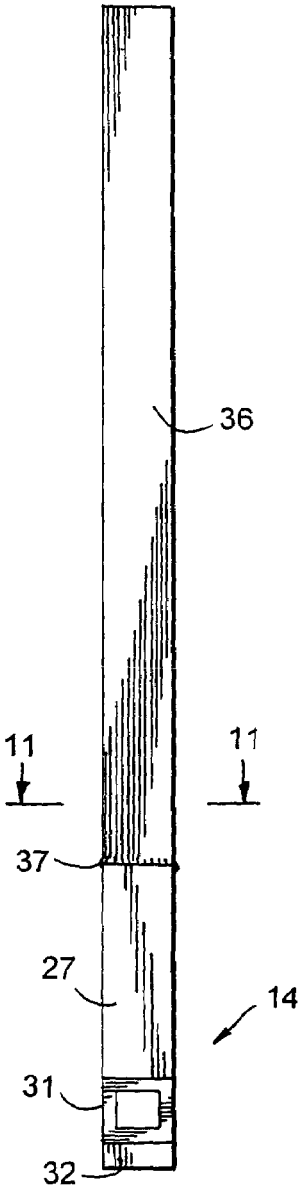
FIG. 9 is an enlarged end view of the arch member and upright bar of FIG. 6.
Figure 10:
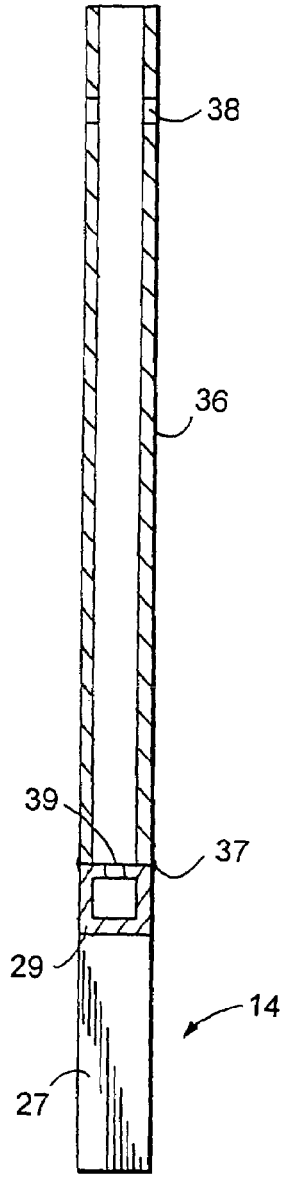
FIG. 10 is an enlarged sectional view taken along line 10-10 of FIG. 6.
Figure 11:
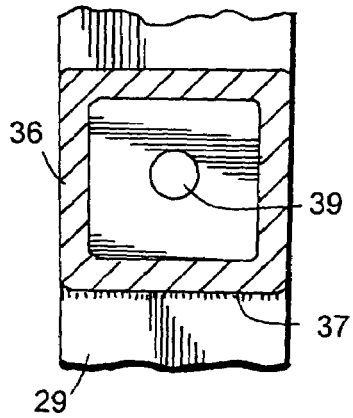
FIG. 11 is an enlarged sectional view taken along line 11-11 of FIG. 9.
Figure 12:
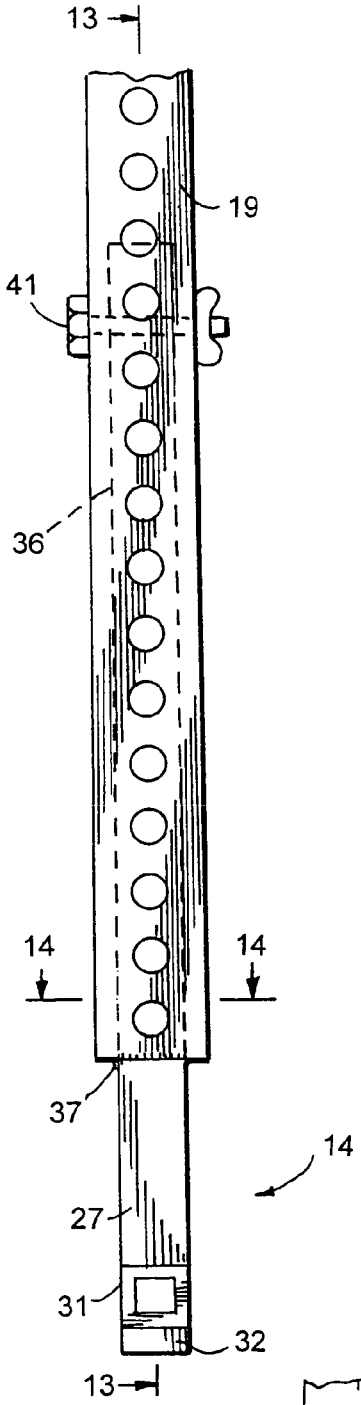
FIG. 12 is an end view of the arch member and upright bar of FIG. 6 accommodating an upright tubular member.
Figure 13:
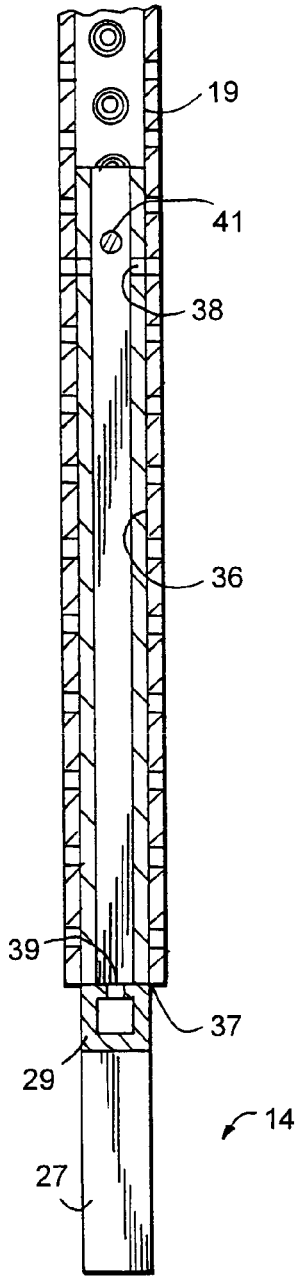
FIG. 13 is a sectional view taken along line 13-13 of FIG. 12.
Figure 14:
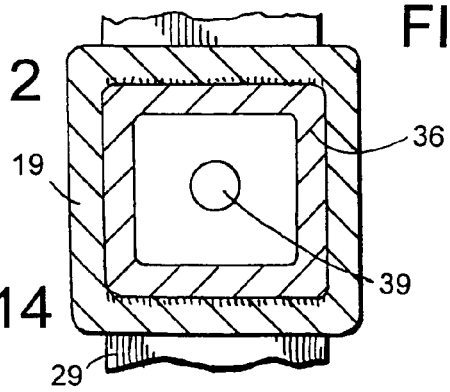
FIG. 14 is an enlarged sectional view taken along line 14-14 of FIG. 12.

A combined sign and support frames 10, shown in FIGS. 1 to 4, comprises a flat square sign member 11 having a front surface accommodating data 12, such as roadway conditions, road repair information and warnings. Member 11 is a rigid metal sheet or plywood board. The sign member can have different shapes and sizes, such as one or more rectangular members. A pair of support frames 13 and 14 and upright members 16 and 19 retain sign member 11 in an upright position above a support surface 24, such as a roadway or road shoulder. The lower edge of sign member 11 is positioned above road surface 24, as shown in FIG. 3. Upright members 16 and 18 are linear square tubes having vertically aligned holes. Fasteners 17 and 18 secure sign member 11 to member 16. Fasteners 21 and 22 secured sign member 11 to upright member 19. Fasteners 17, 18, 21 and 22 are nut and bolt assemblies that firmly secure sign member 11 to members 16 and 19 to prevent separation of sign member 11 from members 16 and 19 when hit by a moving vehicle. The vehicle described herein is an automobile. Other types of motor vehicles including trucks and motor homes can hit the sign and sign support frames 10.

Figure 56:
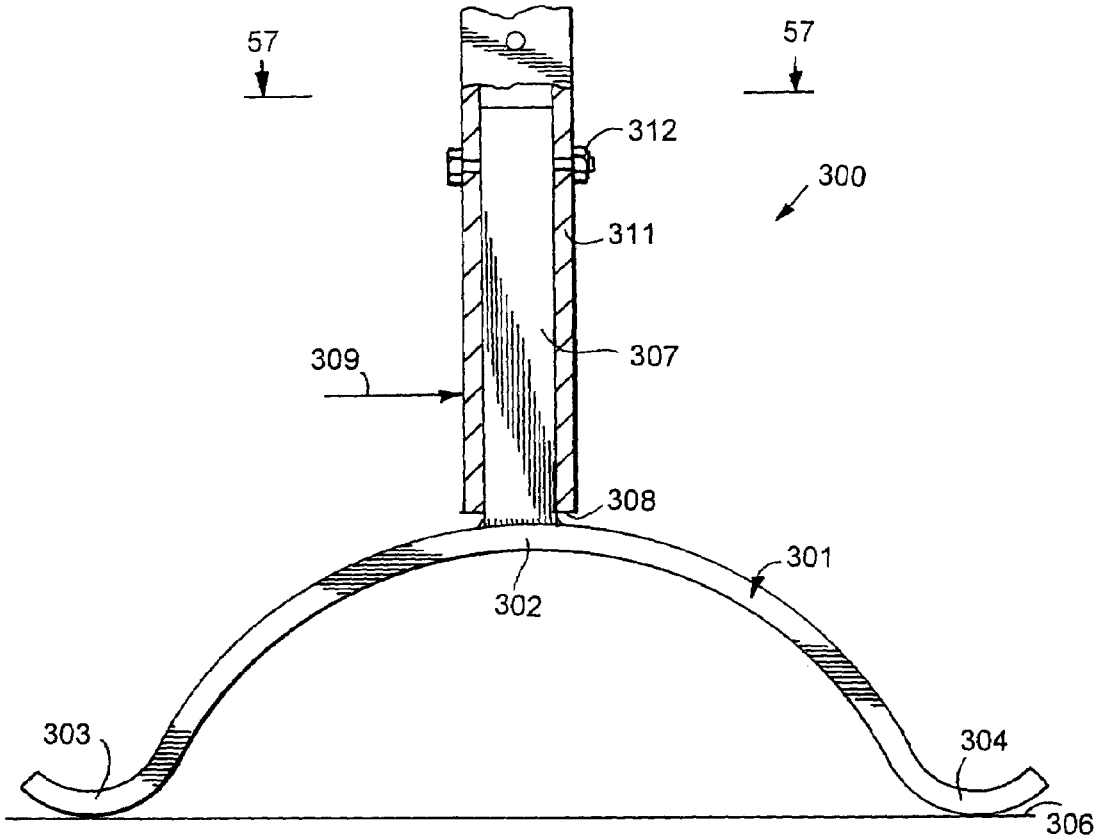
FIG. 56 is a side elevational view partly sectioned of a fourth embodiment of a highway sign and sign support frame of the invention.
Figure 57:
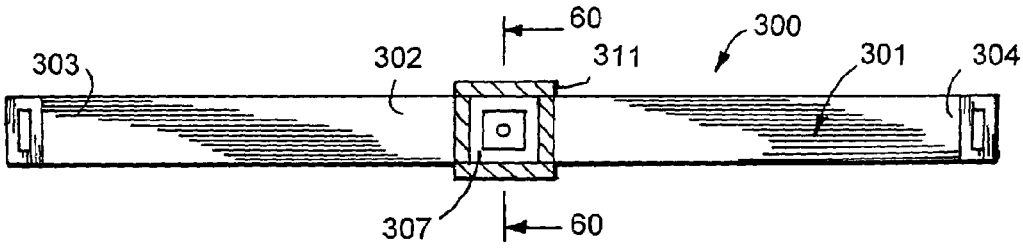
FIG. 57 is a sectional view taken along line 57-57 of FIG. 56.
Figure 58:
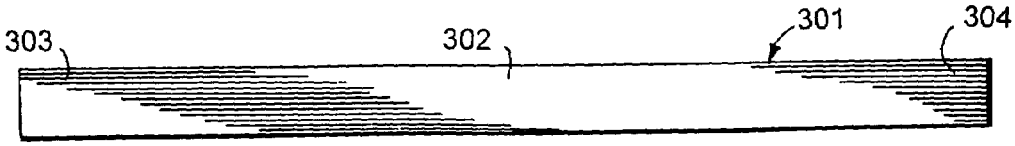
FIG. 58 is a bottom plan view of FIG. 56.

Support frames 13 and 14 are identical in structure and function. The following description is directed to support frame 14. As shown in FIGS. 6 to 11, support frame 14 has an upward arch member 26 having downwardly and outwardly directed legs 27 and 28 joined to a horizontal central bridge 29. The outer end of leg 27 terminates in a foot 31 having an upwardly and outwardly inclined toe or surface 32 on the outer end of the bottom of the foot. The outer end of leg 28 terminates in a foot 33 having an upwardly and outwardly inclined toe or bottom surface 34. The feet 31 and 33 have flat bottom soles or walls that rest on road surface 24 and retain bridge 29 in an elevated position above road surface 24. The inclined toes 32 and 34 function as ramps that inhibit feet 31 and 33 from digging into road surface 24 and glide over sod, gravel and cracks in the road surface. An upright rigid reinforcement bar 36 is secured to the top of bridge 29 with substantial welds 37 which prevent bar 36 from bending and breaking away from bridge 29. Other connectors including gussets and plates can be used to secure bar 36 to bridge 29. Arch member 26 has a horizontal length that is about twice the height or linear upright extent of bar 36. The upper end of bar 36 has a transverse hole 38. An example of arch member 26 and bar 36 is as follows. Arch member 26 is a one-piece square tubular metal member having a length of about sixty inches. Bar 36 is a rigid square tubular steel member having a height of about twenty-four inches. Bridge 29 is elevated about seven inches above road surface 24. Weld 37 extends around the bottom of bar 36 to firmly secure bar 36 to bridge 29. The vertical elevation and length of bridge 29 can vary to change the size and shape of the arch member. The arch member can have an upwardly directed convex shape as shown in FIG. 56.

The mounting of upright member 19 on bar 36 is shown in FIGS. 5, and 12 to 14. Member 19 is an elongated square tube telescoped over bar 36. A fastener 41, shown as a nut and bolt assembly, extends through transverse aligned holes in member 19 and bar 36 to secure member 19 to bar 36. The vertical height of member 19 can be adjusted by raising member 19 relative to bar 36 and aligning a hole in member 19 with hole 38 in bar 36 to accommodate fastener 41. Bar 36 is an upright strength reinforcement of the lower end of member 19 which inhibits bending and breaking of member 19 and bar 36 when hit by a moving motor vehicle. Bar 36 extends upwardly above the area of vehicle impact on the lower portions of the upright members 16 and 19.

Figure 15:
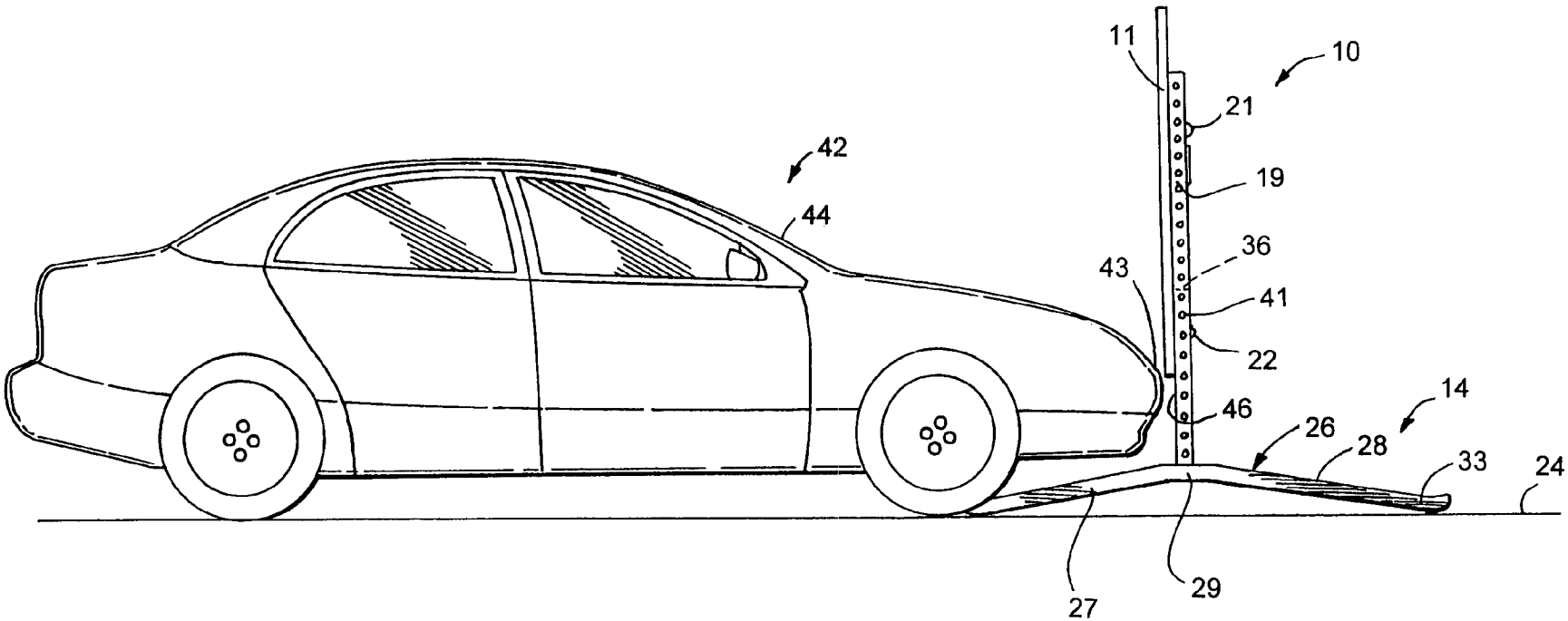
FIG. 15 is a side elevational view of the highway sign and sign support frames in front of a motor vehicle.
Figure 16:
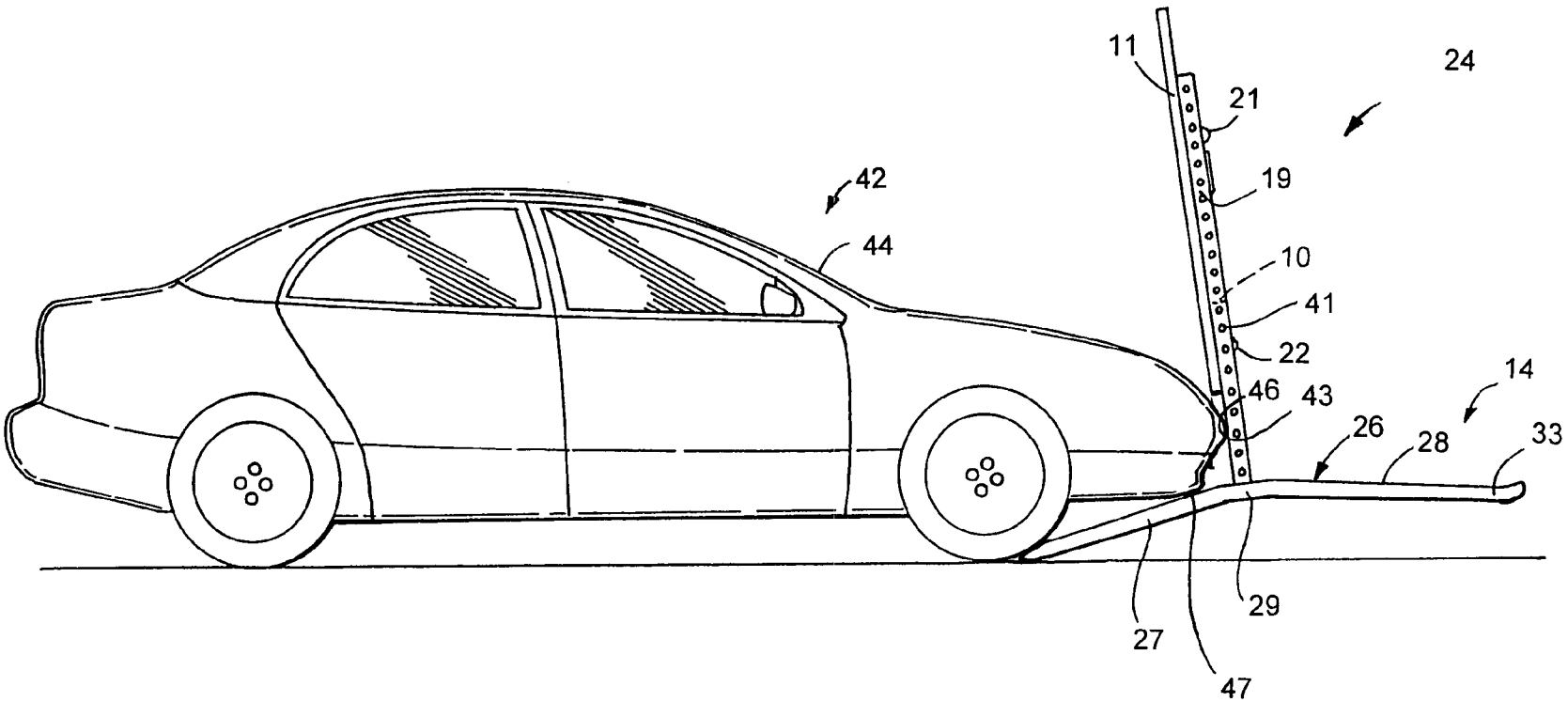
FIG. 16 is a side elevational view of the highway sign and sign support frame impacted by a motor vehicle.
Figure 17:
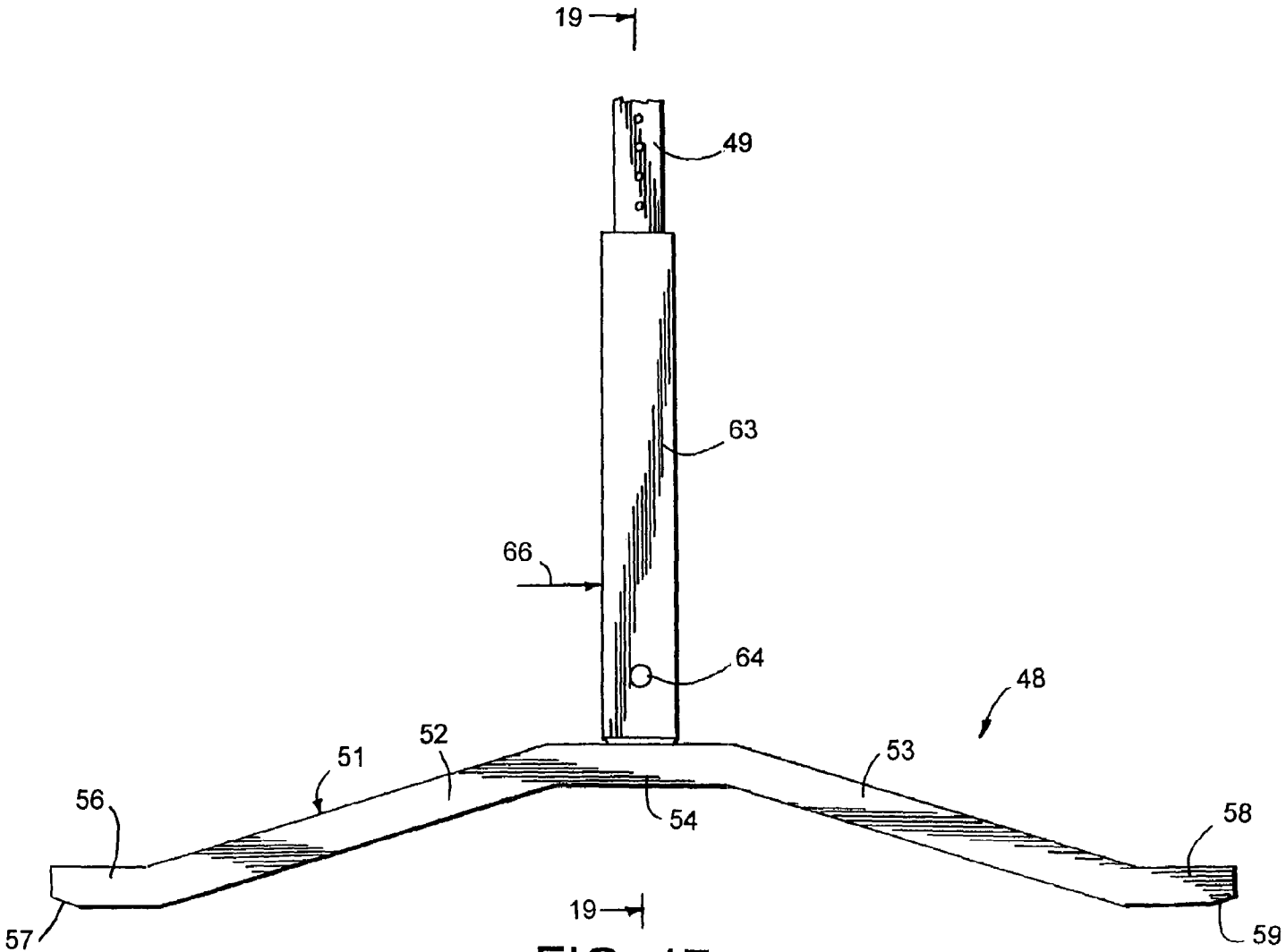
FIG. 17 is a side elevational view of a first modification of a sign support frame.
Figure 18:
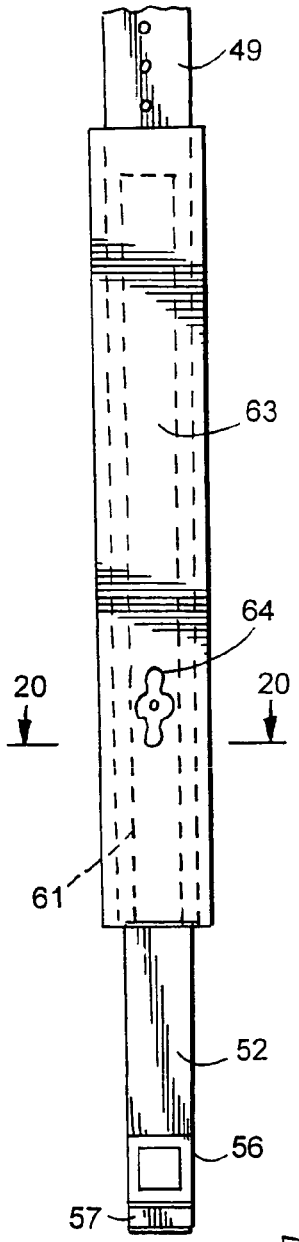
FIG. 18 is an enlarged end elevational view of the sign support frame of FIG. 17.

Referring to FIGS. 15 and 16, there is shown a motor vehicle as an automobile 42 having a conventional front bumper 43 and a windshield 44 located rearwardly of bumper 43. Bumper 43 is positioned about fourteen inches above road surface 24. This distance varies with the type of automobile, truck, motor home and other motor vehicles. When automobile 42 moves forward and hits sign support frames 10, bumper 43 impacts members 16 and 19 in the area 46 above arch member 26 and at or above the center of gravity of frame 14. This area is reinforced with bar 36. The entire sign and support frames 10 are raised and forced in a rearward direction toward automobile 42. Arch members 26 tilt upwardly and engage the bottom 47 of bumper 43 or front frame of automobile 42. This prevents further upward and rearward movements of upright members 16 and 19 and sign member 11 toward windshield 44. The entire sign and support frames 10 are moved with automobile 42 along road surface 24. The impact force of automobile 43 hitting member 19 at or above the center of gravity of frame 14 reduces rearward forces on the upper end of member 19 and sign attached thereto. The inertia center of frame 14 below the motor vehicle impact area counteracts the inertia center of the upright members' mass above the motor vehicle impact area until the entire frames, upright members and sign are accelerated to the speed of the motor vehicle. Sign member 11 remains attached to members 16 and 19 a period of time after impact. Bar 36 does not separate from arch member 26 during the acceleration of the sign support frame after impact by the automobile. The sign and support frames 10 remain intact. The sign member 11 does not engage windshield 44 and arch member 26 does not penetrate the floor and front walls of the driver and passenger compartment of automobile 42.

Figure 19:
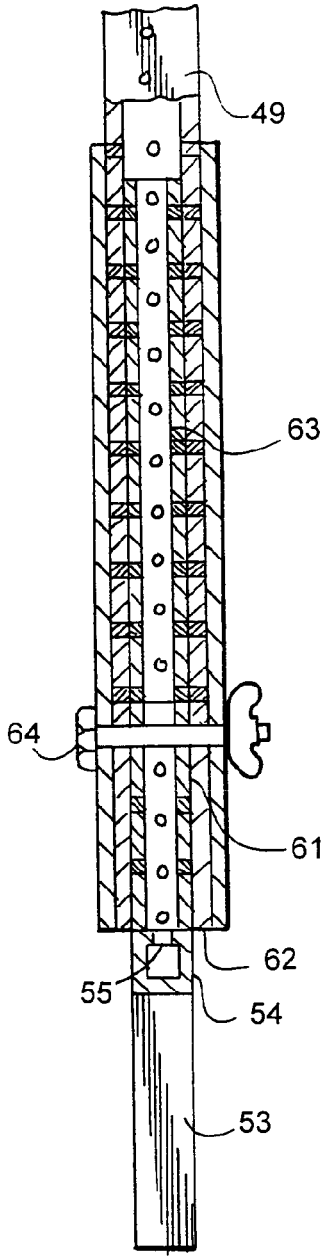
FIG. 19 is an enlarged view taken along line 19-19 of FIG. 17.
Figure 20:
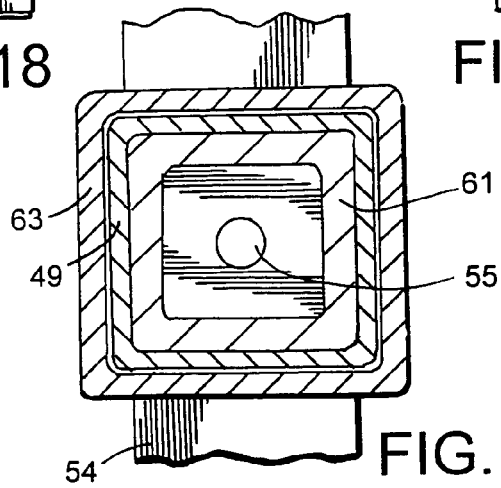
FIG. 20 is an enlarged sectional view taken along line 20-20 of FIG. 18.
Figure 21:
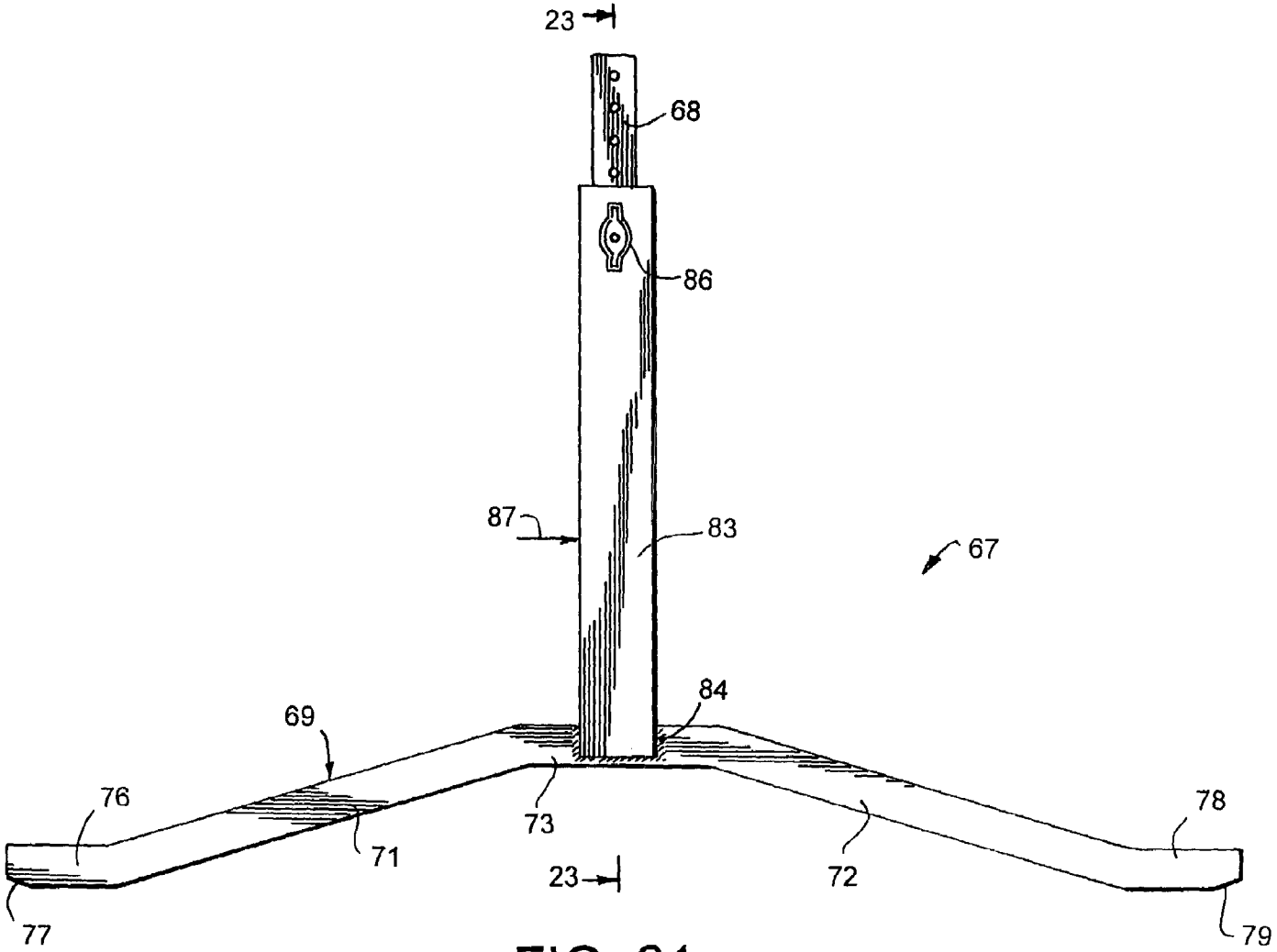
FIG. 21 is a side elevational view of a second modification of a sign support frame.
Figure 22:
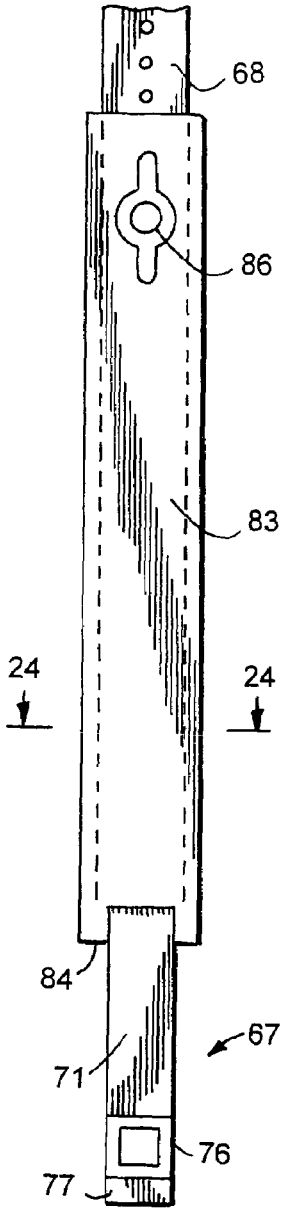
FIG. 22 is an enlarged end view of the sign support frame of FIG. 21.

A first modification of the sign support frame and reinforcement thereof 48 for upright member 49 connected to sign member 11 is shown in FIGS. 17 to 20. Arch member 51 has outwardly and downwardly diverging legs 52 and 53 connected to a horizontal bridge 54. Legs 52 and 53 terminate in feet 56 and 58 having inclined toes or walls 57 and 59. Arch member 51 is a one-piece tubular bar formed into the arch shape shown in FIG. 17. As shown in FIG. 19, an upright tubular reinforcement bar 61 is secured with weld 62 to bridge 54. Other connectors including gussets and plates can be used to secure bar 61 to bridge 54. Bridge 54 has a hole 55 open to the interior of bar 61 to allow water to drain from bar 61 and member 49. Member 49 telescopes over bar 61. An upright tubular sleeve 63 extends around member 49. Sleeve 63 is an upright square tubular rigid metal member that provides additional structural strength to the lower end of member 49 and bar 61. Sleeve 63 can be a U-shaped or channel shaped member located around three sides of member 49. Angle members can also be used to reinforce the lower end of member 49 and bar 61. A fastener 64, shown as a nut and bolt assembly, extends through transverse aligned holes in bar 61, member 49, and sleeve 63 to hold member 49 and sleeve 63 in assembled relation with bar 61. As shown by arrow 66 in FIG. 17, the automobile impact area is at the front of sleeve 63 above bridge 54 and below the upper end of sleeve 63. This area is reinforced with bar 61 and sleeve 63 to maintain the structural integrity of sign support frame 48. When sleeve 63 is hit with automobile bumper 46, arch member 51 turns and move upwardly to engage the bottom of bumper 46 or the front frame of automobile 42, as shown in FIG. 16. This limits further upward and reward movement of sign member 11 toward windshield 44 and reduces the forces on weld 62.

A second modification of the support frame, indicated generally at 67 in FIGS. 21 to 24, is attached to upright member 68 adapted to be fastened to sign member 11. Support frame 67 to further reinforce member 89. A fastener 97, shown as a nut and bolt assembly, secures member 89 and sleeve 96 to bar 93. An upwardly and rearwardly directed leg or ramp 98 is secured with a weld 99 to the first side of sleeve 96. A fastener 101, shown as a nut and bolt assembly, secures the forward end of leg 98 to base member 91. As shown in FIG. 26, nut 102 of fastener 101 is located within the forward end of base member 91. The top of leg 98 adjacent sleeve 96 is located above base member 91. The vertical distance between the top of leg 98 adjacent sleeve 96 and base member 91 is about seven inches. Other vertical dimensions can be used which are sufficient to clear the bottom of an automobile bumper. Sleeve 96 has an impact area, shown by arrow 103 in FIG. 25, above leg 98 and below the upper end of sleeve 96. When sleeve 96 is hit with a moving motor vehicle, frame 88 lifts and turns rearwardly until leg 98 engages the bottom of the bumper or front frame of the motor vehicle. The bottom of the bumper limits lift and turning movements of frame 88, member 89 and the sign secured to member 89 and reduces the force on weld 94 that secures bar 94 to base member 91.

Figure 23:
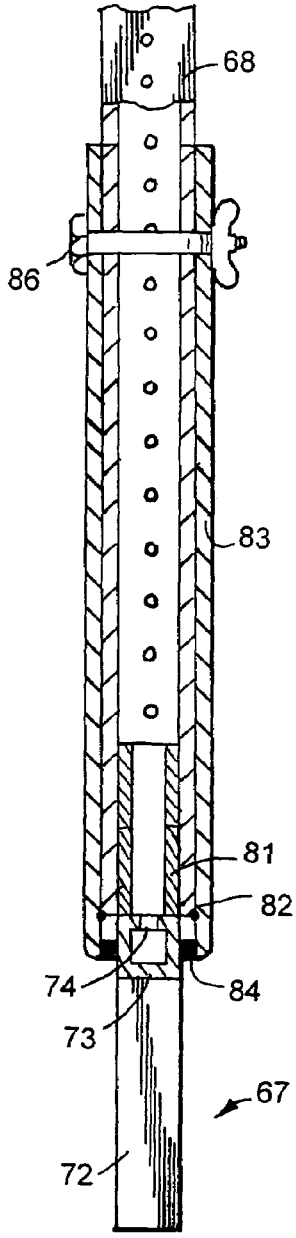
FIG. 23 is a sectional view taken along line 23-23 of FIG. 22.
Figure 24:
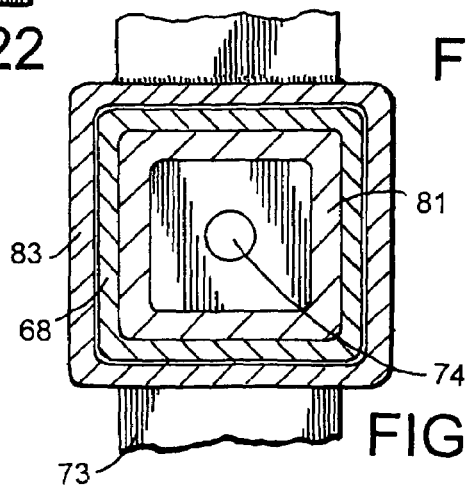
FIG. 24 is an enlarged sectional view taken along line 24-24 of FIG. 22.
Figure 25:
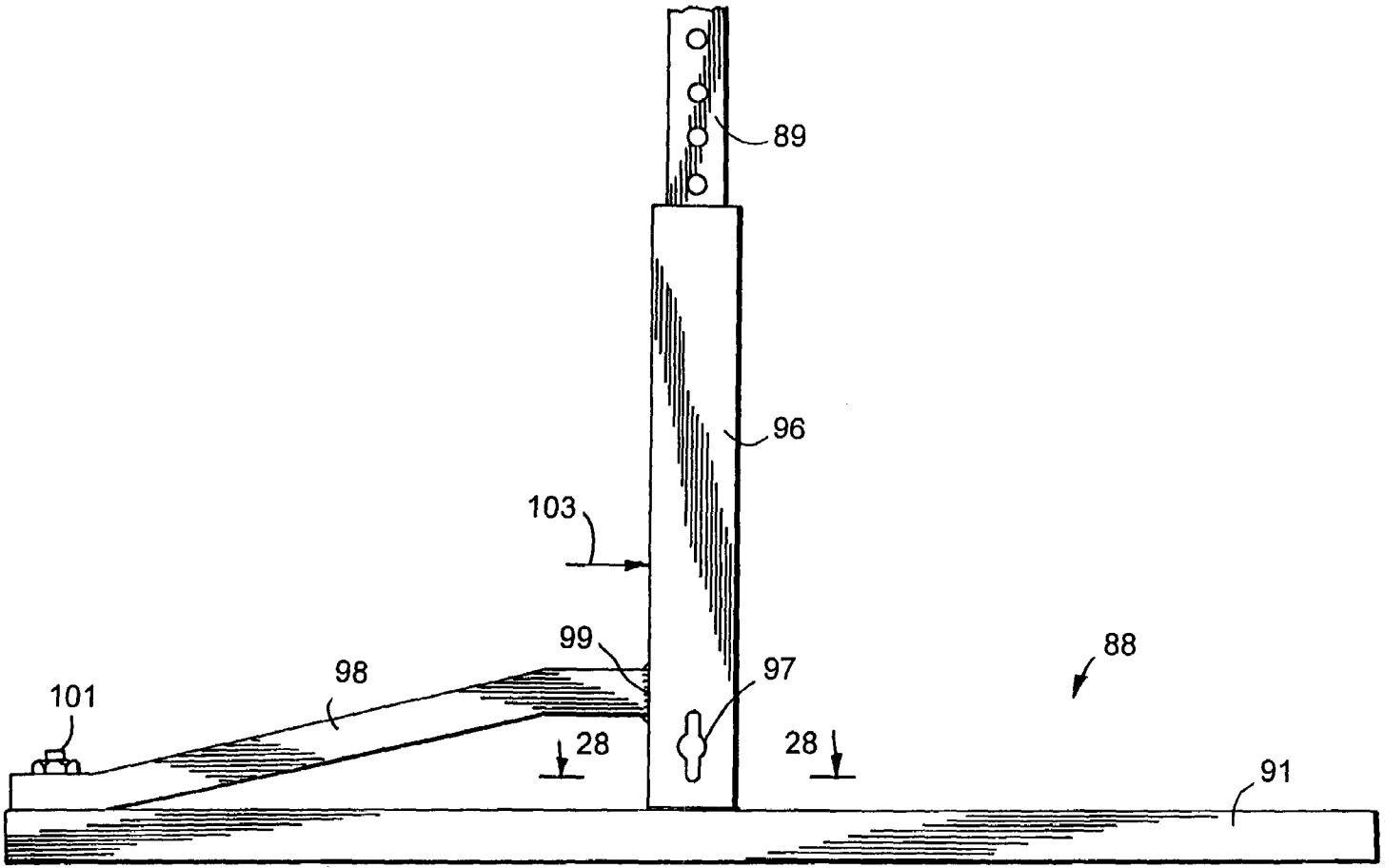
FIG. 25 is a side elevational view of a third modification of a sign support frame.
Figure 26:
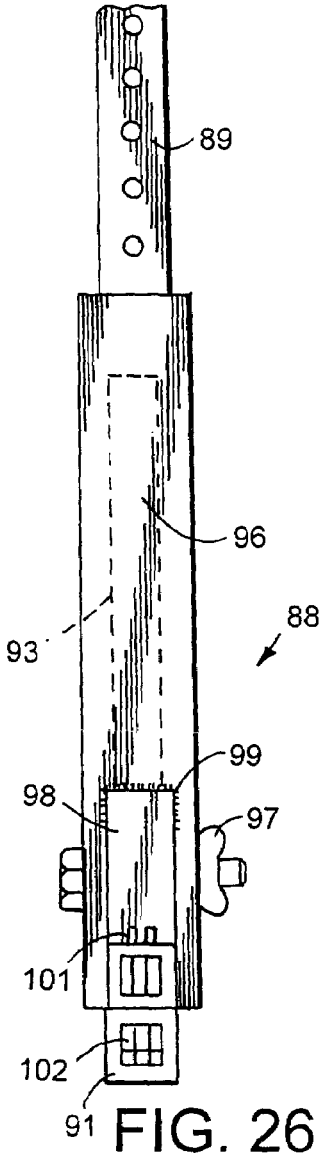
FIG. 26 is an end elevational view of the left end of the sign support frame of FIG. 25.
Figure 27:
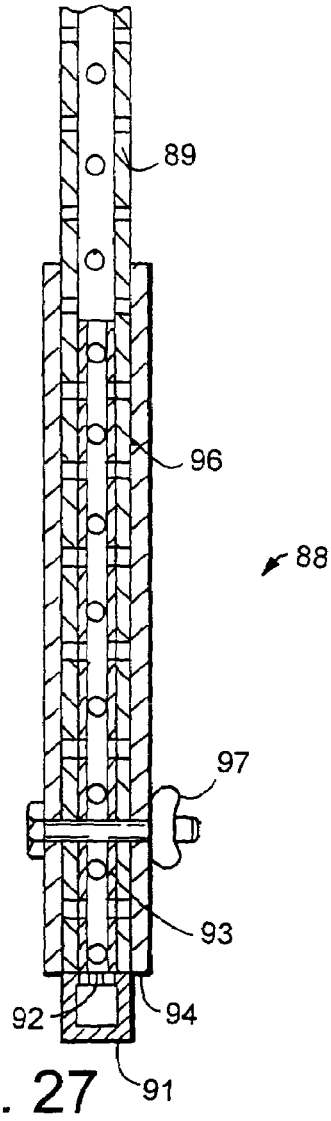
FIG. 27 is a sectional view taken along line 27-27 of FIG. 25.
Figure 28:
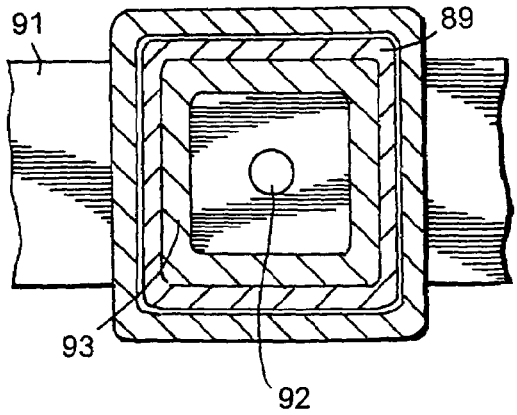
FIG. 28 is an enlarged sectional view taken along line 28-28 of FIG. 25.
Figure 29:
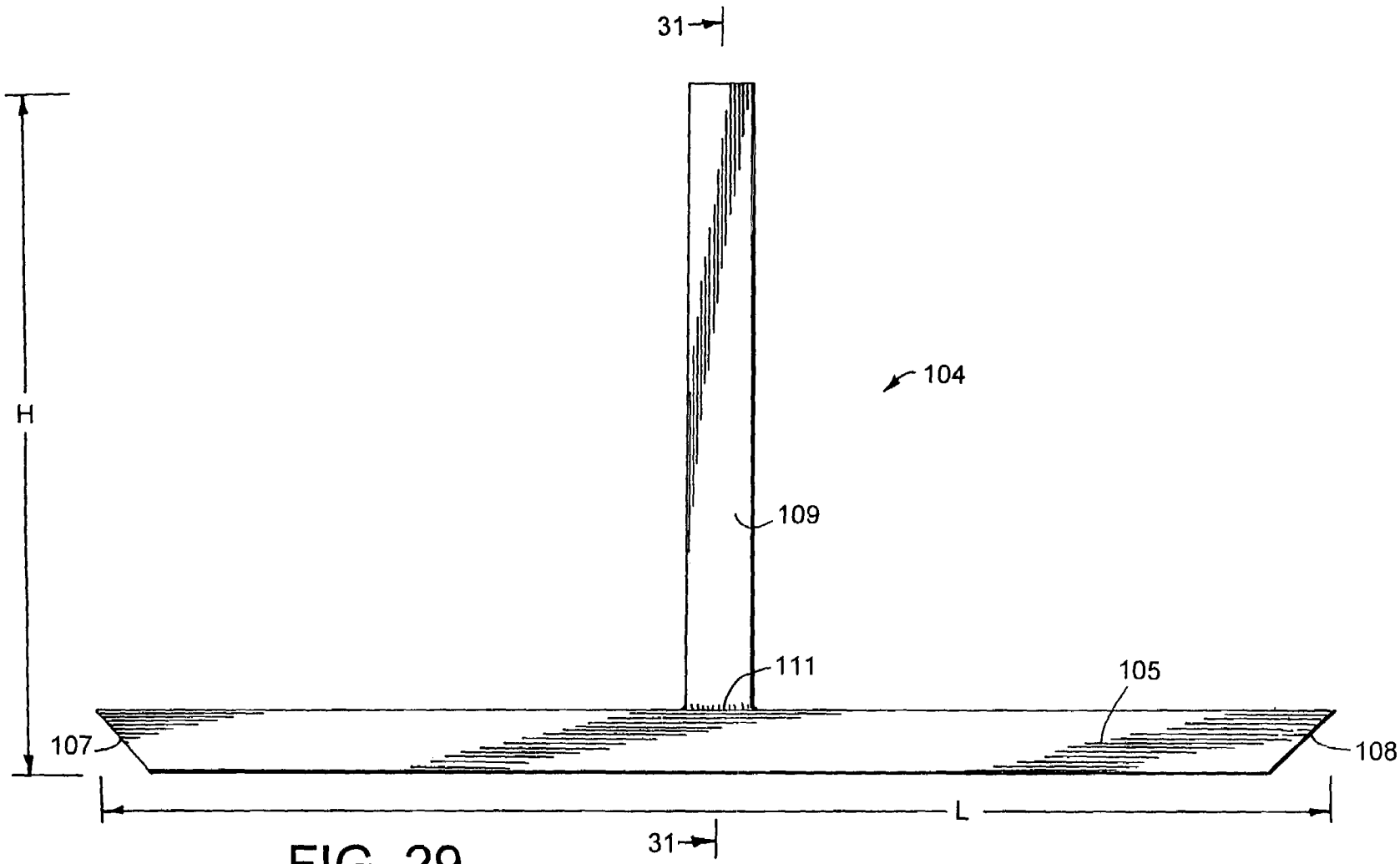
FIG. 29 is a side elevational view of a fourth modification of a sign support frame.
Figure 30:
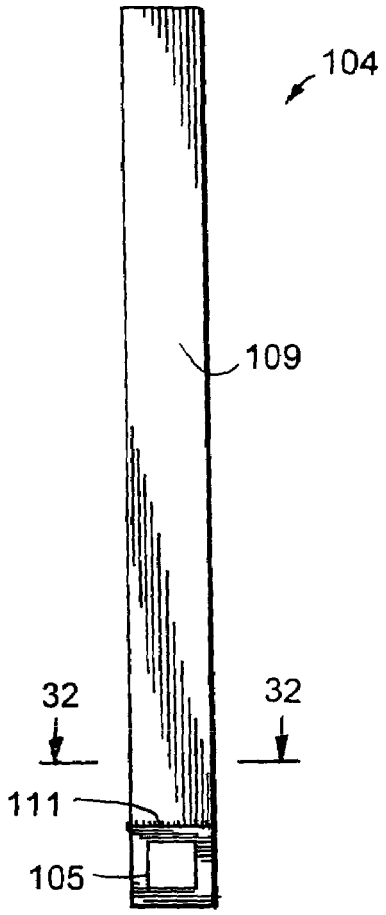
FIG. 30 is a side elevational view of FIG. 29.
Figure 31:
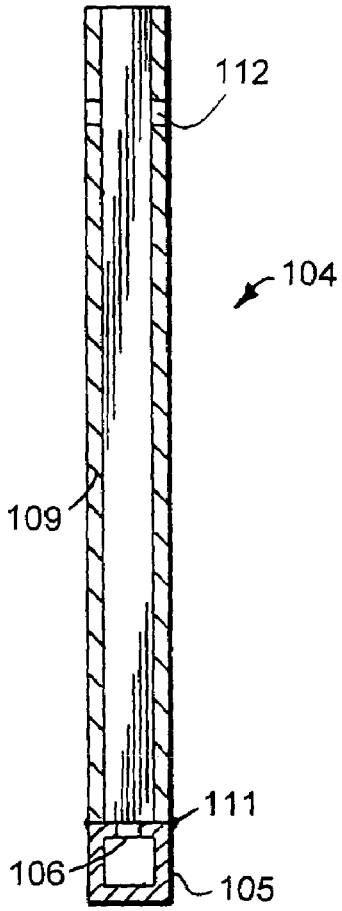
FIG. 31 is a sectional view taken along line 31-31 of FIG. 29.
Figure 32:
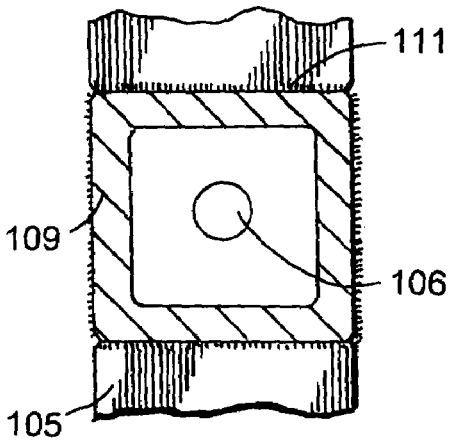
FIG. 32 is an enlarged sectional view taken along line 32-32 of FIG. 30.

A fourth modification of the sign support frame is indicated generally at 104 in FIGS. 25 to 35. Frame 104 has a linear base member 105 comprising an elongated metal square tubular member. Member 105 can have other shapes including, but not limited to, a solid bar and a round or rectangular tubular metal member. The opposite ends 107 and 108 of base member 105 are inclined upwardly and outwardly to allow base member 105 to slide along a road surface and inhibit ends 107 and 108 from digging into the road surface. An upright tubular bar 109 is secured with a weld 111 to the top of the base member 105. Weld 111 extends around bar 109 to firmly connect bar 109 to base member 105. As shown in FIG. 31, the upper end of bar 109 has a transverse hole 112. Base member 105 has a hole 106 open to bar 109 to allow water to drain from bar 109. Returning to FIG. 29, base member 105 has a horizontal length L that is has an arch member 69 comprising legs 71 and 72 joined to a horizontal bridge 73. The outer ends of legs 71 and 72 terminate in feet 76 and 78 having lower toes 77 and 79. As shown in FIGS. 23 and 24, an upright bar 81 secured by welds 82 to bridge 73 extends into the lower end of member 68. Bridge 73 has a hole 74 open to bar 81 to allow water to drain from bar 81 and member 68. A tubular sleeve 83 surrounding the lower portion of member 68 is secured by a weld 84 to bridge 73. A fastener 86, shown as a nut and bolt assembly, secures sleeve 83 to member 68. Sleeve 83 has a height that extends above the motor vehicle bumper impact area shown by arrow 87 in FIG. 21. The impact area 87 is above the center of gravity of combined arch member 67 and sleeve 83. Sleeve 83 is rigid square metal tubular member that reinforces the lower portion of member 68. Bar 81 and sleeve 83 being welded to bridge 73 do not break away from arch member 67 when hit by a moving motor vehicle. Arch member 67 turns and moves upwardly into engagement with the bottom of the bumper or front frame of the automobile when sleeve 83 is hit with a moving motor vehicle. Arch member 67 limits forward movement of member 68 and sign secured thereto and reduces the force exerted on sleeve 83 and welds 82 and 84.

Figure 33:
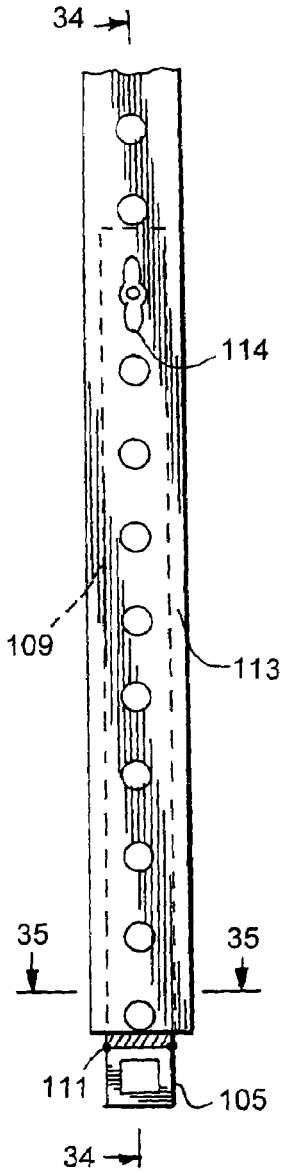
FIG. 33 is an end elevational view of the sign support frame of FIG. 29 attached to an upright tubular member.
Figure 34:
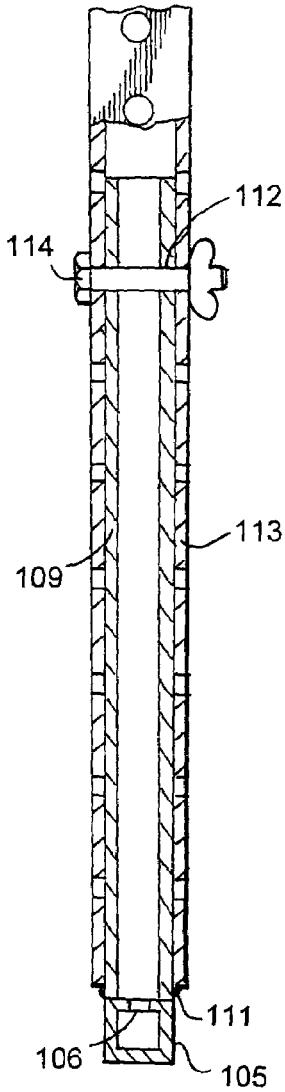
FIG. 34 is a sectional view taken along line 34-34 of FIG. 33.
Figure 35:
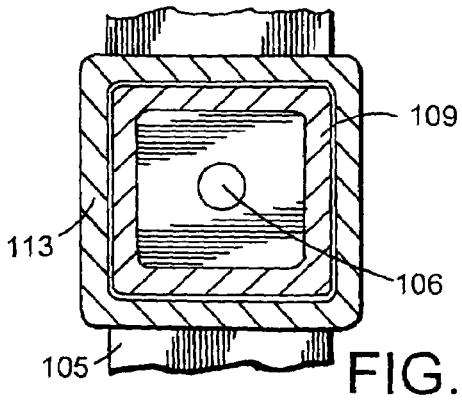
FIG. 35 is an enlarged sectional view taken along line 35-35 of FIG. 33.
Figure 36:
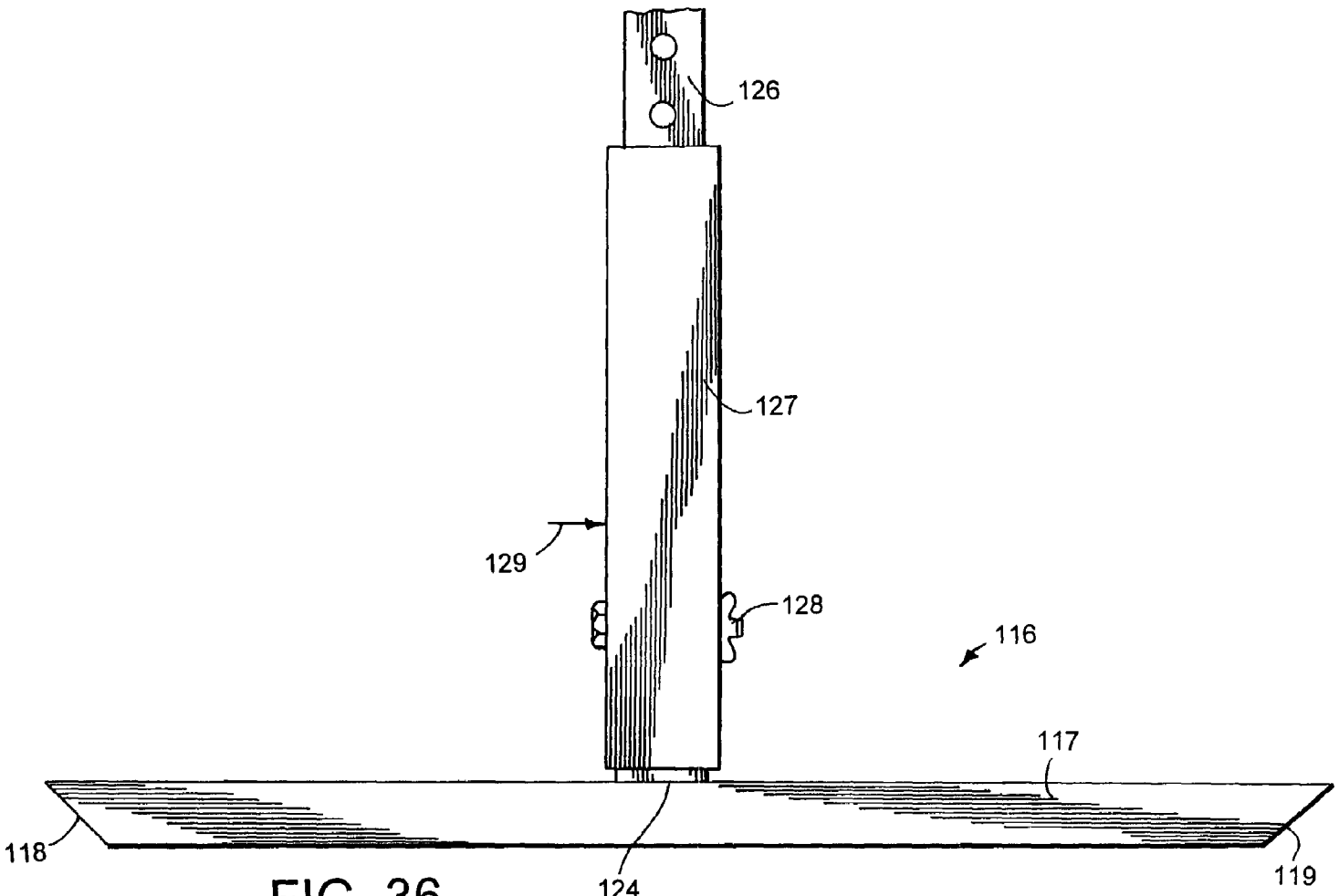
FIG. 36 is a side elevational view of a fifth sign support frame accommodating an upright tubular member.
Figure 37:
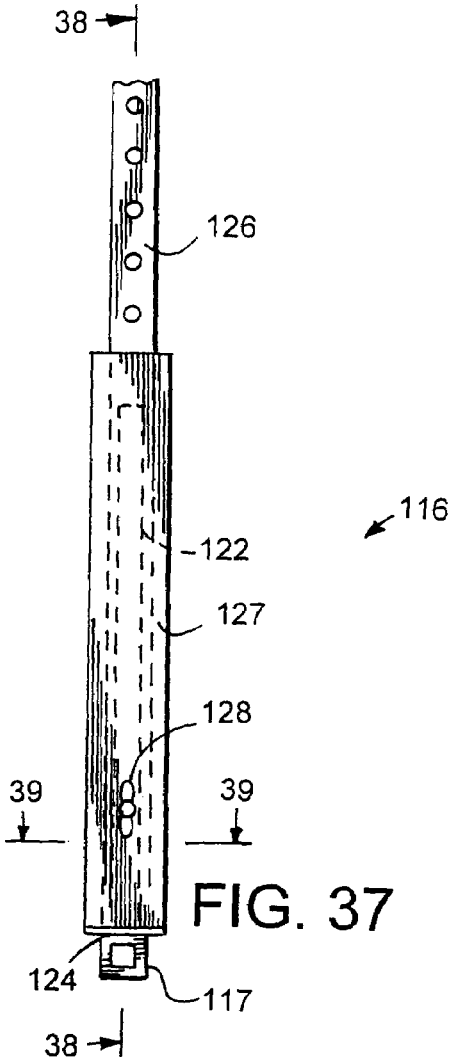
FIG. 37 is an end elevational view of FIG. 36.
Figure 38:
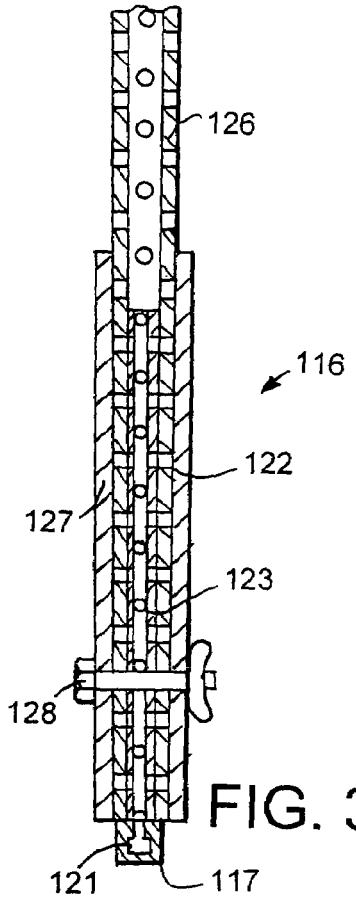
FIG. 38 is a sectional view taken along line 38-38 of FIG. 37.

A third modification of the sign support frame for a sign, shown generally at 88 in FIGS. 25 to 28, is connected to an upright member 89 for supporting a sign, such as sign 11. Frame 88 has a linear base member 91 shown as a square tubular metal member. An upright reinforcement bar 93 is secured with a weld 94 to the top of the middle section of member 91. Other connectors including gussets, plates and bolts can be used to attach bar 93 to member 91. Base member 91 has a hole 92 open to bar 93 to allow water to drain from bar 93. The lower portion of member 89 telescopes over bar 93 to mount member 89 on frame 88 and reinforce the lower portion of member 89. A sleeve 96 is positioned around the lower portion of member 89 twice the height H of bar 109. An example of frame 104 is a base member 105 comprising two-inch square galvanized steel tubular member having a length of sixty inches. Bar 109 is a two-inch square galvanized steel tubular member having a length of thirty inches. Base member 105 can be 2×6 or 2×8 inch metal or wood members. Weld 111 is a continuous bead weld surrounding the bottom of bar 109 to firmly secure bar 109 to base member 105. As shown in FIGS. 33 to 35, an upright member 113 for supporting a sign has a lower portion telescoped relative to bar 109. A fastener 114, shown as a nut and bolt assembly, secures upright member 113 to bar 109. Upright member 113 has rows of vertically spaced holes that allow vertical alignment of member 113 on bar 109. Bar 109 extends above an impact area of a motor vehicle hitting member 113 and locates the center of gravity of frame 104 below the impact area. The impact force of the motor vehicle hitting member 109 above the center of gravity of frame 104 reduces the rearward forces of the upper portion of member 113 and sign attached thereto. This inhibits bending and breaking of member 113 adjacent the upper end of bar 109.

Figure 39:
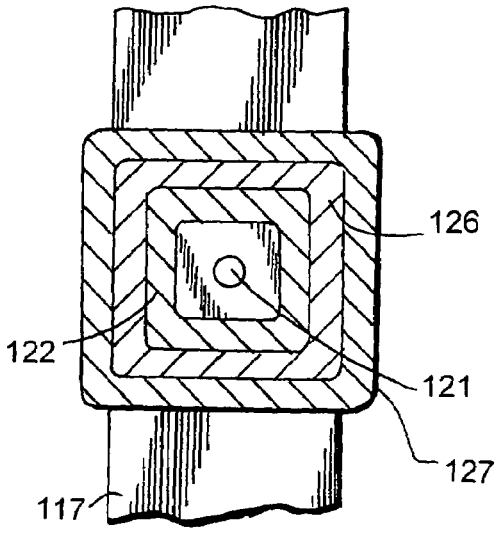
FIG. 39 is an enlarged sectional view taken along line 39-39 of FIG. 37.
Figure 40:
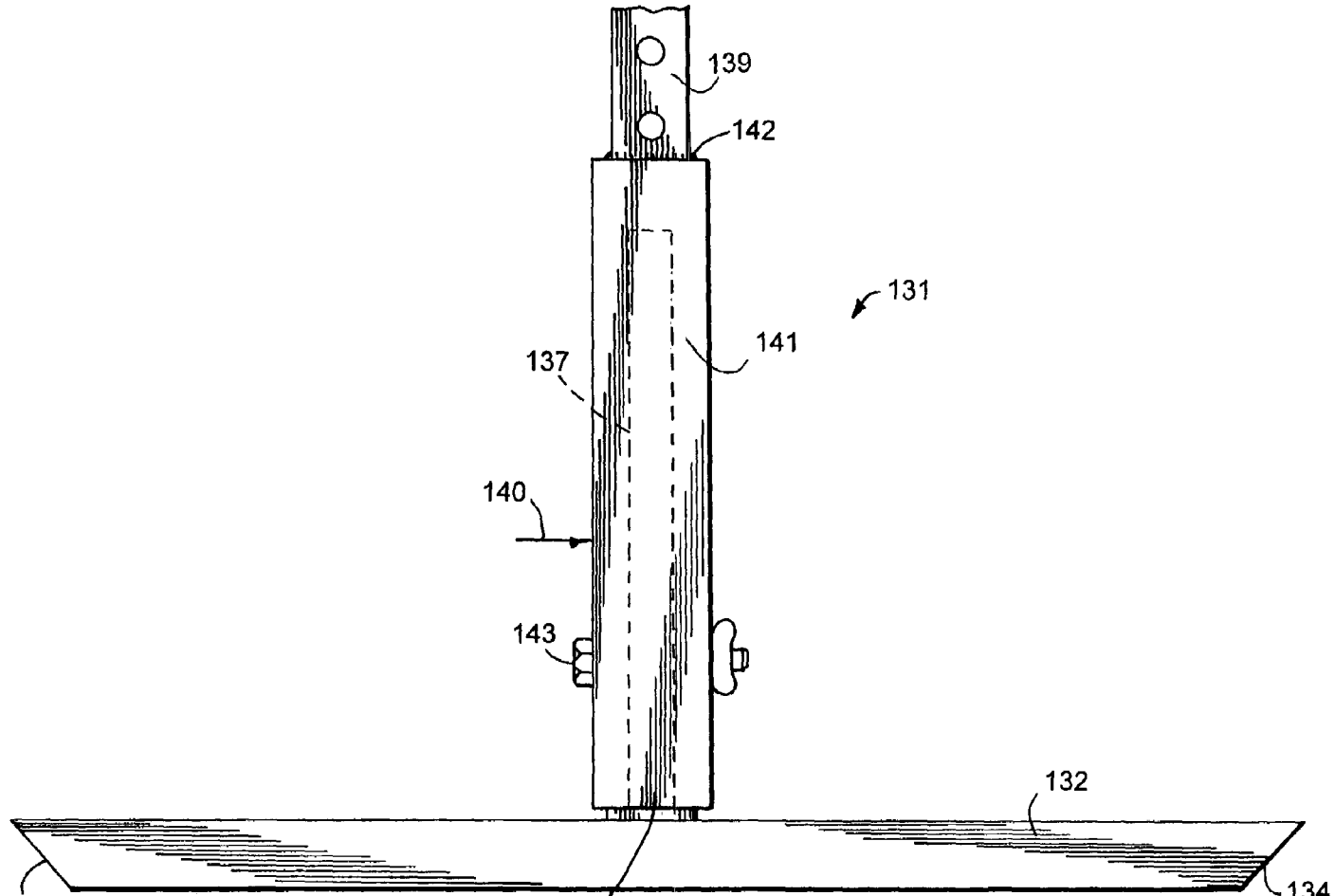
FIG. 40 is a side elevational view of a sixth sign support frame accommodating an upright member.
Figure 41:
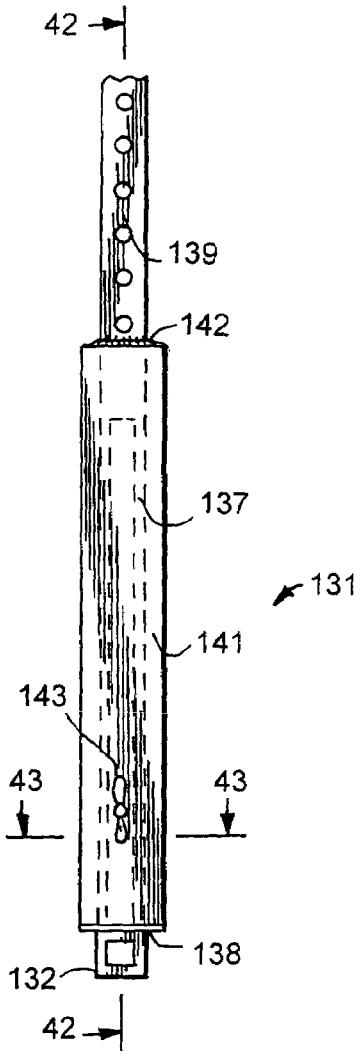
FIG. 41 is a side elevational view of FIG. 40.
Figure 42:
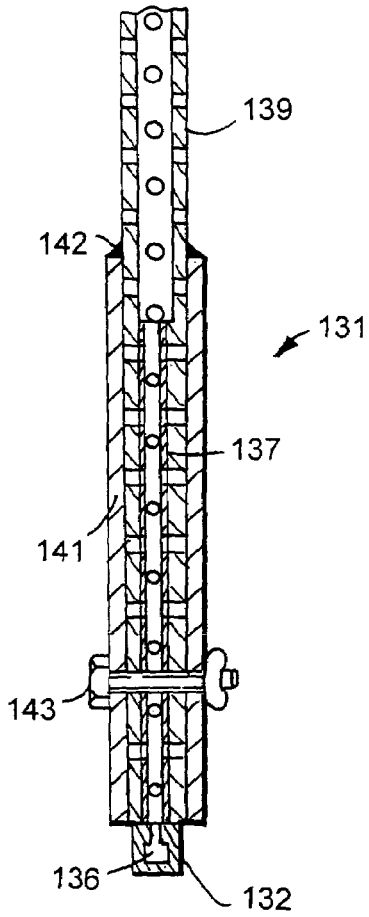
FIG. 42 is a sectional view taken along line 42-42 of FIG. 41.
Figure 43:
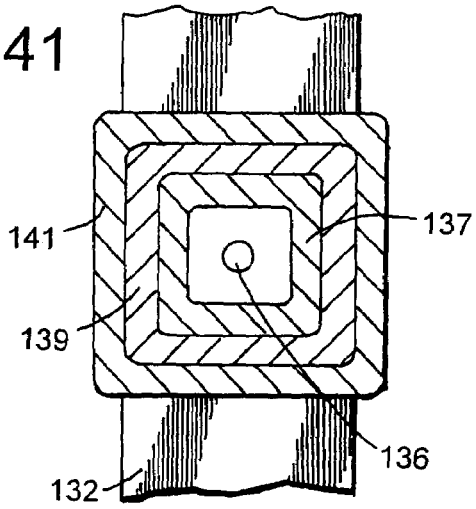
FIG. 43 is an enlarged sectional view taken along line 43-43 of FIG. 41.

A fifth modification of the sign support frame is indicated generally at 116 in FIGS. 36 to 39. Frame 116 has an elongated linear base member 117 having upwardly and outwardly inclined ends 118 and 119. Member 117 is a metal square tubular member. An upright reinforcement bar 122 with holes 123 is secured with a weld 124 to base member 117. Bar 122 has a height of about half the length of base member 117. A hole 121 in base member 117 allows water to drain from the inside of bar 122. An upright member 126 for supporting a sign has a lower portion telescoped over bar 122 to mount member 126 on frame 116. An upright rigid sleeve 127 surrounds the lower portion of member 126. As shown in FIG. 39, sleeve 127 has a square cross section with inside walls located in close relation to the square outside walls of member 126. The inside walls of member 126 are located in close relation to the square outside walls of bar 122. The telescopic relationship between bar 122, member 126, and sleeve 127 provides a strong reinforcement of member 126. A fastener 128, shown as a nut and bolt assembly, secures member 126 and sleeve 127 to bar 122. Sleeve 127 extends upwardly above the impact area, shown by arrow 129 in FIG. 36, of an automobile hitting sleeve 127. Impact area 129 is above the center of gravity of frame 116. Bar 122 and sleeve 127 reinforce member 126, reduce bending and breaking forces on weld 124, and minimize the rearward force on the upper end portion of member 126 and sign connected to member 126.

A sixth modification of the sign support frame is indicated generally at 131 in FIGS. 40 to 43. Frame 131 has a linear base member 132 having upwardly and outwardly inclined ends 133 and 134. Base member 132 is a square tubular metal member having a middle section secured to an upright reinforcement bar 137 with a weld 138. Base member 132 has a hole 136 open to the inside of bar 137 to allow water to drain from bar 137. An upright member 139 supporting a sign has a lower end portion telescoped over bar 137 to support member 139 on frame 131. A rigid sleeve 141 comprising a square metal tube is located around member 139. The upper end of sleeve 141 is secured with a weld 142 to member 139. A fastener 143, shown as a nut and bolt assembly, secures member 139 and sleeve 141 to bar 137. Bar 137 and sleeve 141 reinforce member 139 and reduce the effect of the bending and breaking forces of the frame. The impact area, shown by arrow 140 in FIG. 40, of a motor vehicle hitting sleeve 141 is below the top of sleeve 141 and above the center of gravity of frame 131. The relationship between the impact area 140 on sleeve 141 below the center of gravity of frame 131 reduces the rearward forces applied to the upper end of member 139 and sign attached thereto. This minimizes the separation of the sign from member 139.

Figure 44:
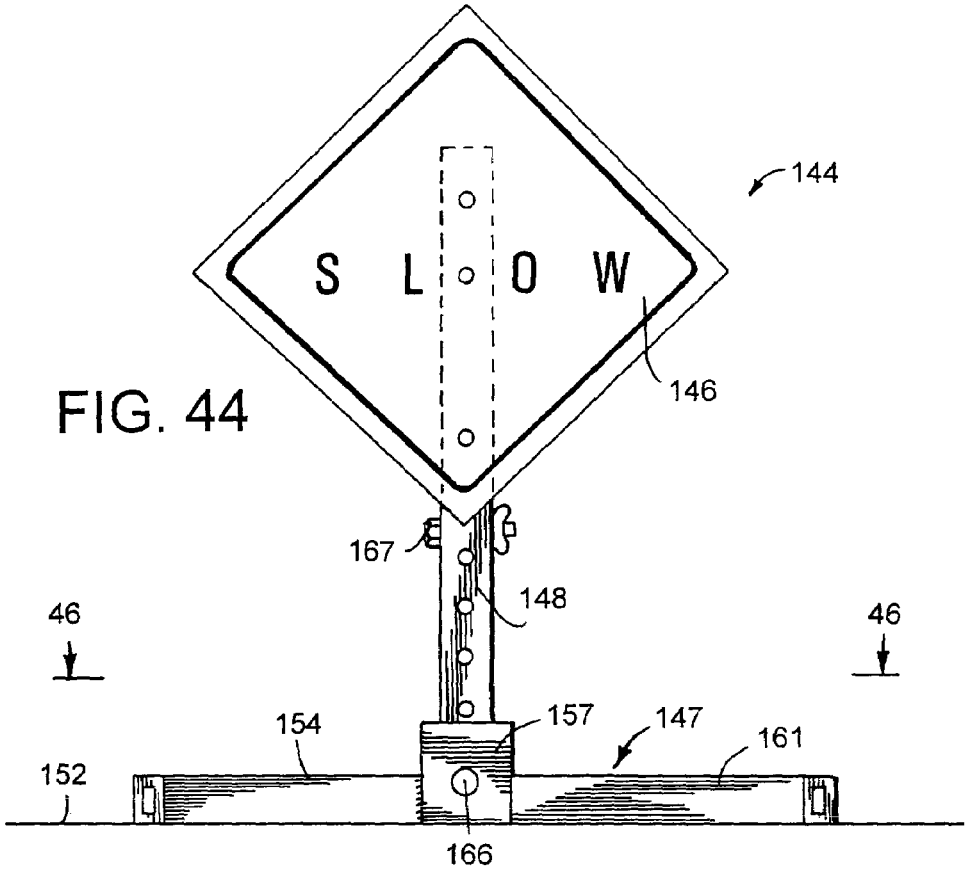
FIG. 44 is a front elevational view of a first modification of the sign support frame of the invention and sign attached thereto.
Figure 45:
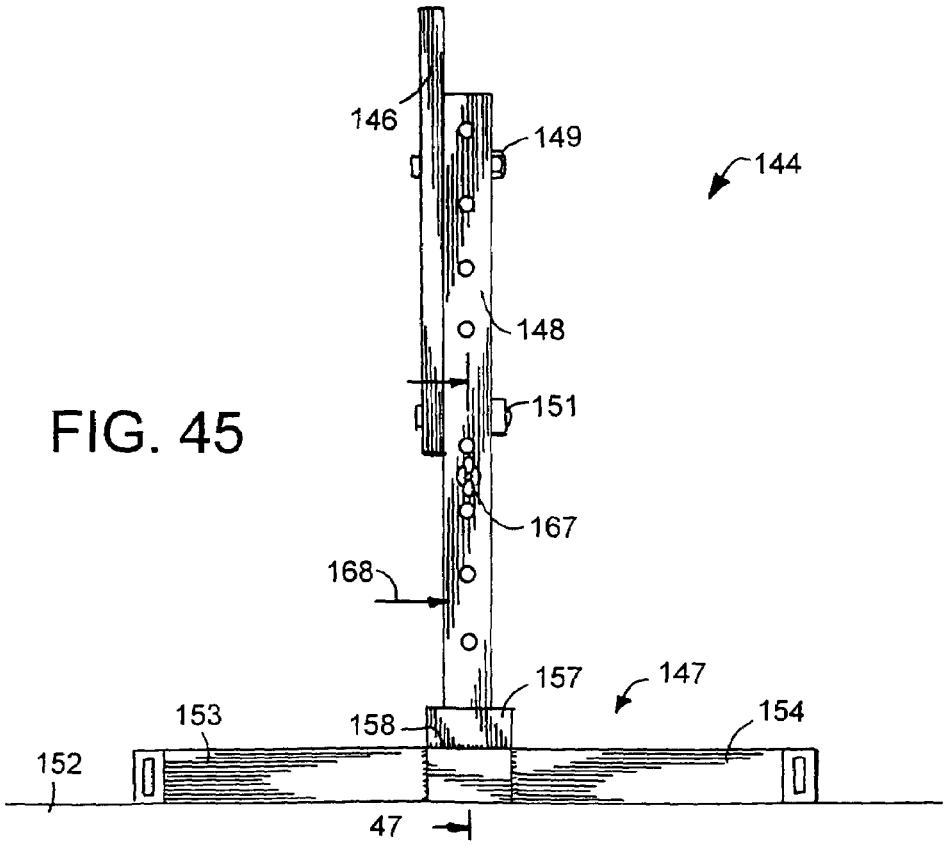
FIG. 45 is a side elevational view of FIG. 44.
Figure 46:
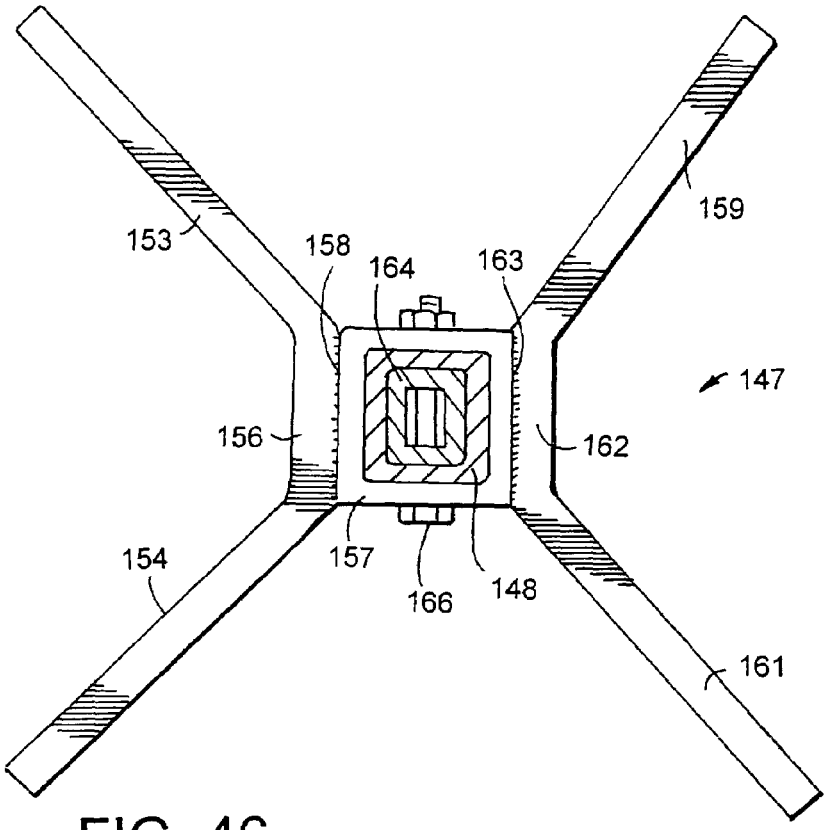
FIG. 46 is an enlarged sectional view taken along line 46-46 of FIG. 44.
Figure 47:
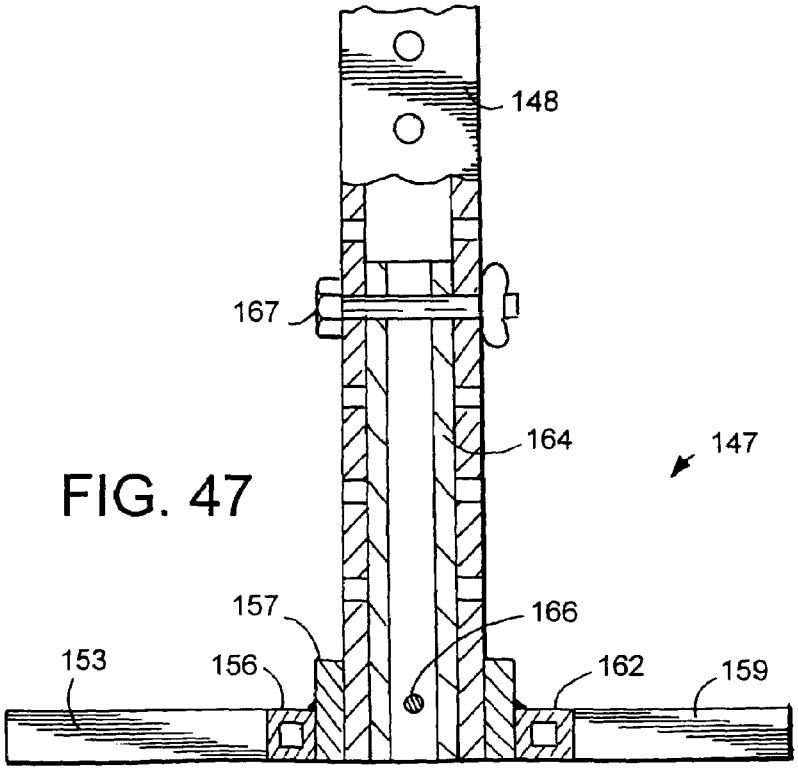
FIG. 47 is an enlarged sectional view taken along line 47-47 of FIG. 45.

A second highway sign and sign support frame, indicated generally at 144 in FIGS. 44 and 45, has an upright flat sign 146 containing visual data for motorists. Sign 146 is a generally square wood or metal panel attached to an upright tubular member 148. The lower end of member 148 is connected to a sign support frame 147. Fasteners 149 and 151, shown as nut and bolt assemblies, secure sign 146 to member 148. Sign support frame 147 supported on roadway 152 or the shoulder of a road retains sign 146 in an upright position above roadway 152 to located the visual data on the sign in viewing alignment with an automobile operator. Frame 147 has a first pair of outwardly diverging legs 153 and 154 joined to a base 156. Base 156 is secured with a weld 158 to a receiver 157. As shown in FIGS. 46 and 47, receiver 157 is a square tubular member extended upwardly from base 156. A second pair of outwardly diverging legs 159 and 161 joined to a base 162 are located opposite legs 153 and 154. A weld 163 secures base 162 to receiver 157. An upright reinforcement bar 164 extends upwardly from receiver 157 into a lower portion of member 148. A fastener 166, shown as a nut and bolt assembly, secures member 148 and bar 164 to receiver 157. Bar 164 can be welded to receiver 157. A second fastener 167, shown as a nut and bolt assembly, secures member 148 to the upper end of bar 164. Bar 164 has a height or vertical length of between twenty to thirty inches or above the automobile impact area, shown by arrow 168 in FIG. 45, on member 148. The outwardly diverging legs 153, 154 and 159, 161 longitudinally and laterally stabilize member 148 and sign 146 and prevent turning or twisting of sign 146. Bar 164 reinforces the lower portion of member 148. The center of gravity of frame 147 is below impact area 168 whereby the bending and breaking forces on fasteners 166 and receiver 157 are reduced and the rearward force on the upper end portion of member 148 and sign 146 are minimized.

Figure 48:
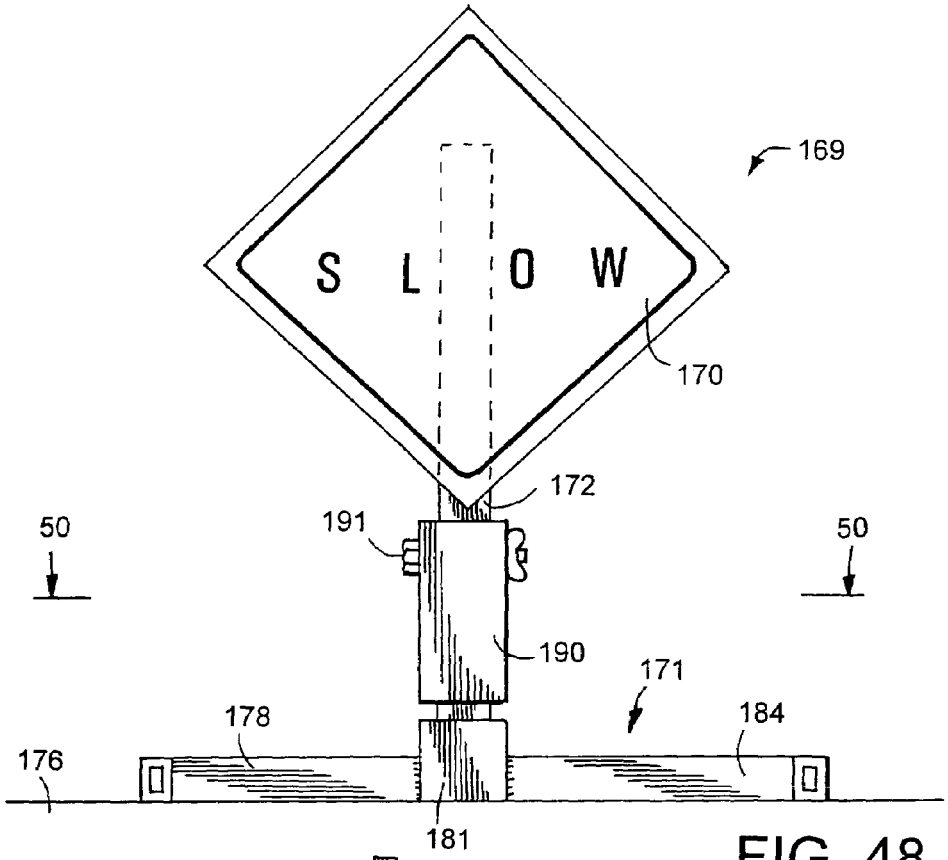
FIG. 48 is a front elevational view of a second modification of the sign support frame of the invention and sign attached thereto.
Figure 49:
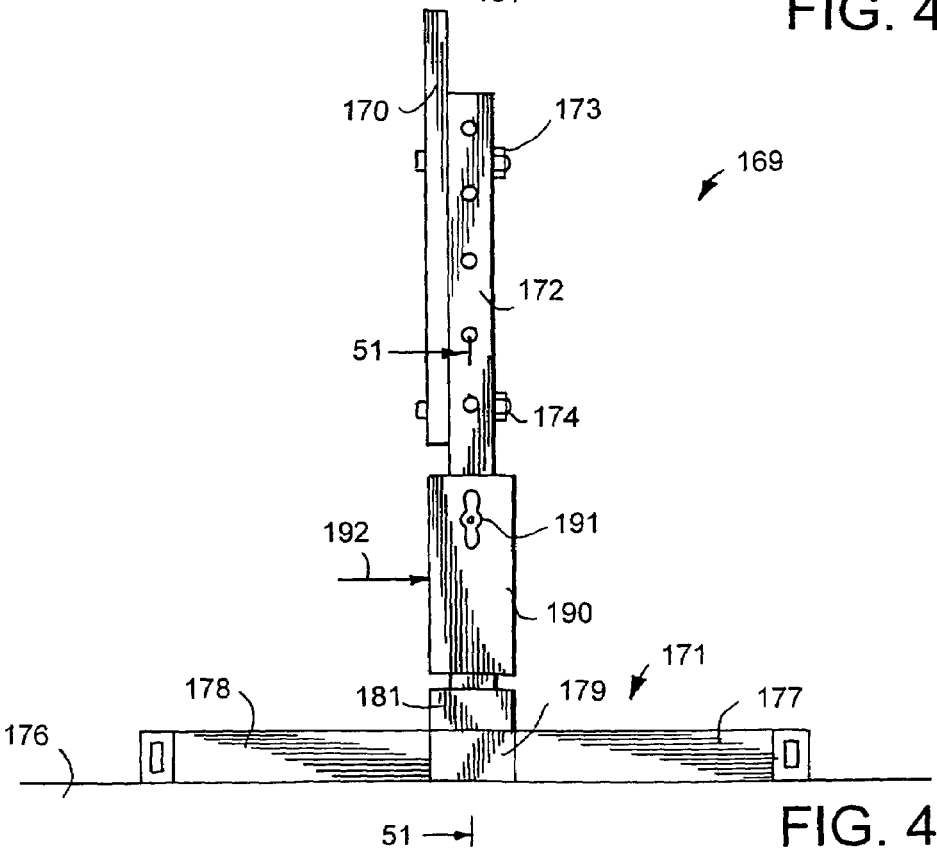
FIG. 49 is a side elevational view of FIG. 48.
Figure 50:
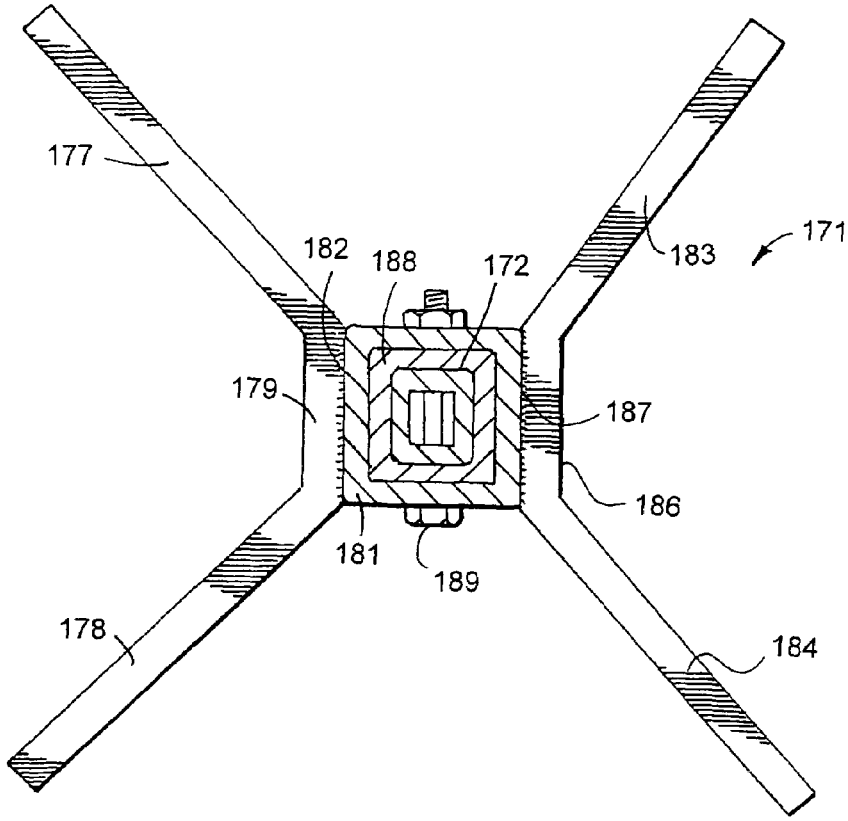
FIG. 50 is an enlarged sectional view taken along line 50-50 of FIG. 48.
Figure 51:
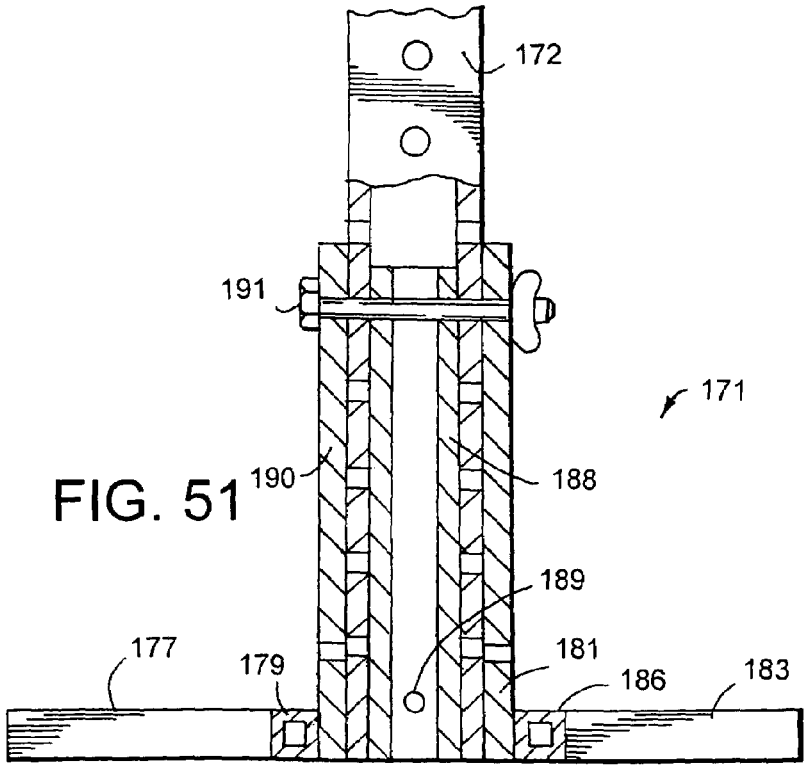
FIG. 51 is an enlarged sectional view taken along line 51-51 of FIG. 49.

A third highway sign and sign support frame, indicated generally at 169 in FIGS. 48 and 49, has a flat upright sign 170 containing visual data of road or driving conditions secured to an upright member 172 mounted on a sign support frame 171. Fasteners 173 and 174, shown as nut and bolt assemblies, secure sign 170 to member 172. As shown in FIGS. 50 and 51, frame 171 has a first pair of outwardly diverging legs 177 and 178 joined to a base 179. Base 179 is secured to a receiver 181 or upright tubular member with a weld 182. A second pair of outwardly diverging legs 183 and 184 are joined to a base 186 which is secured by a weld 187 to receiver 181. The pairs of legs 177, 178 and 183, 184 are tubular members that diverge outwardly in opposite directions to longitudinally and laterally stabilize frame 171 on roadway 176. An upright reinforcement bar 188 extends upwardly from receiver into the lower portion of member 172. A fastener, shown as a nut and bolt assembly, secures 172 and bar 188 to receiver 181. Bar 188 can be welded to receiver 181. A tubular sleeve 190 surrounds the lower end member 172. A fastener 191, shown as a nut and bolt assembly in FIG. 51, secures member 172 and sleeve 190 to bar 188. Bar 188 and sleeve 190 have heights or vertical lengths extended above the automobile impact area, shown by arrow 192 in FIG. 49 to reinforce the lower end portion of member 172 and reduce bending and breaking forces on member 172. The center of gravity of frame 171 is below impact area 192 whereby the bending and breaking forces on fastener 189 is further reduced and the rearward force on the upper end portion of member 172 and sign 170 are minimized.

Figure 52:
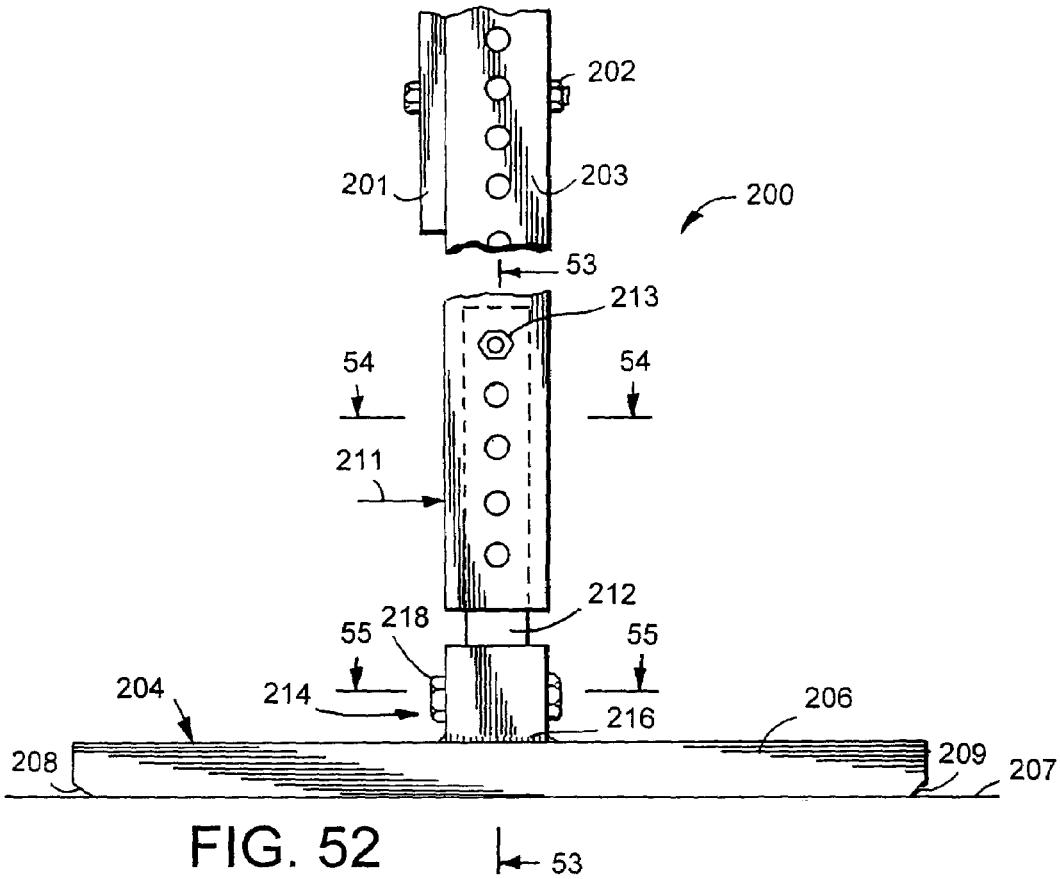
FIG. 52 is a foreshortened side elevational view of a third embodiment of a highway sign and sign support frame of the invention.
Figure 53:
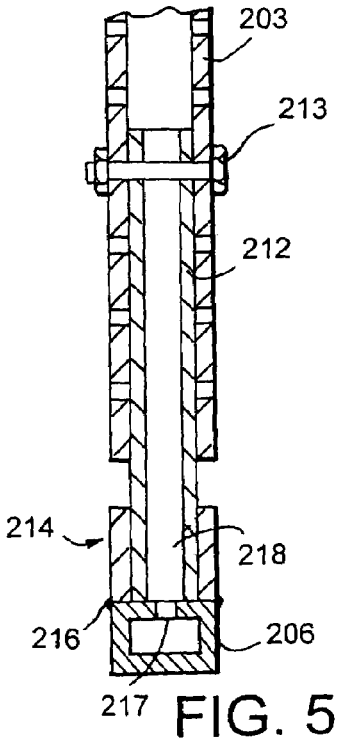
FIG. 53 is a sectional view taken along line 53-53 of FIG. 52.
Figure 54:
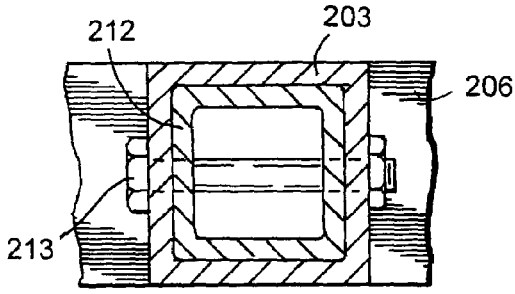
FIG. 54 is an enlarged sectional view taken along line 54-54 of FIG. 52.
Figure 55:
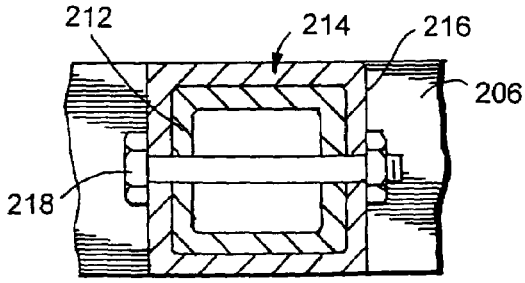
FIG. 55 is an enlarged sectional view taken along line 55-55 of FIG. 52.

A fourth highway sign and sign support frame, indicated generally at 200 in FIG. 52, has an upright sign 201 comprising a flat wood or metal panel containing visual data or road conditions or driving directions secured with fasteners 202 to an upright metal member 203. Member 203 is a square linear tube having rows of holes along its length. A frame 204 has an elongated base member 206 located on a support surface 207, such as a road or a road shoulder. Base member 206 is an elongated linear metal tubular member having upwardly turned outer lower ends 208 and 209. Ends 208 and 209 are inclined to prevent base member 206 from digging into support surface 207 when member 203 is hit with the bumper of a motor vehicle as shown by arrow 211. An upright reinforcement bar 212 telescoped into the lower end portion of member 203 is connected to member 203 with a fastener 213, shown as a nut and bolt assembly. Other types of fasteners including removable pins can be used to connect member 203 to bar 212. The lower end of bar 212 fits into a receiver 214 secured with a weld 216 to the middle section of base member 206. Receiver 214 is a short upright metal tubular member aligned with a hole 217 in base member 206. Hole 217 allows water to drain from tubular bar 212 and upright member 203. A fastener 218, shown as a nut and bolt assembly, connects the bottom of bar 212 to receiver 214. Fasteners 213 and 218 can be removed from member 203, receiver 214, and bar 212 to allow base member 206, upright member 203, and bar 212 to be shipped and stored in flat side-by-side positions. As shown in FIG. 52, bar 212 extends upwardly from base member 206 above the motor vehicle impact area shown by arrow 211. The impact area 211 is at or above the center of gravity of base member 206 and bar 212. Bar 212 reinforces the lower portion of upright member 203 and inhibits the bending and breaking of upright members 203 when subjected to forces resulting from the impact of an automobile hitting upright member 203. Receiver 214 has inside upright walls in surface contact with the lower end of bar 212. The flat walls of receiver 214 absorbs lateral forces from bar 212 which minimizes the forces applied to fastener 218.

Figure 59:
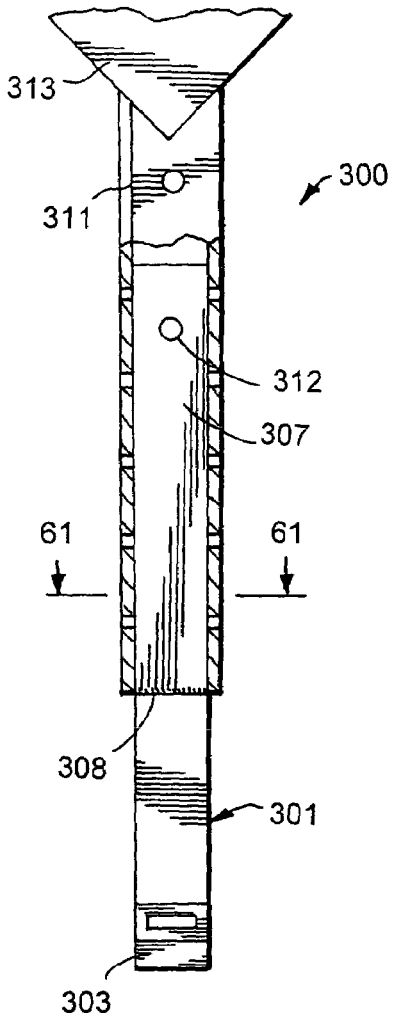
FIG. 59 is an end elevational view, partly sectioned, of FIG. 56.
Figure 60:
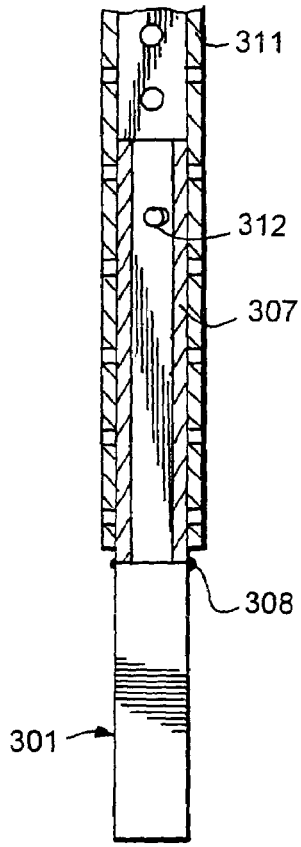
FIG. 60 is a sectional view taken along line 60-60 of FIG. 57.
Figure 61:
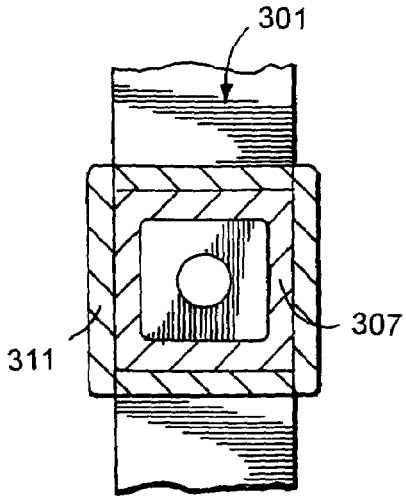
FIG. 61 is an enlarged sectional view taken along line 61-61 of FIG. 59.

An arch sign support frame, indicated generally at 300 in FIGS. 56 and 59, has a pair of supports. Each support has an arch member 301 having a top or center portion 302 and opposite ends joined to concave curved feet 303 and 304 located in engagement with a support surface 306. Arch member 301 is a one-piece rigid tubular metal member having an upwardly curved arc and concave curved feet 303 and 304. The arc of member 301 can have a sixty degree apex angle which provides member 301 with substantial strength and stability. An upright reinforcement bar 307 is secured with welds 308 to middle portion 302 of arch member 301. Bar 307 is a rigid metal tubular member. Other connecting devices, such as bolts and rivets, can be used to secure bar to arch member 301. Bar 307 extends upwardly from arch member 301 above a motor vehicle impact area shown by arrow 309. Impact area 309 is above the center of gravity of sign support frame 300. Bar 307 has a vertical height of about one half the longitudinal distance between feet 303 and 304. In one embodiment, the distance between feet 303 and 304 is forty-eight inches and the vertical height of bar 307 is twenty-four inches. An upright member 311 has a lower end portion located around bar 307. Member 311 is a linear square tubular metal member having rows of vertically spaced holes. A fastener 312, shown as a nut and bolt assembly, connects bar 307 to upright member 311. The vertical height of sign 313 can be adjusted by raising member 311 relative to bar 307 and aligning the holes in member 311 and bar 307 to accommodate fastener 312. Bar 307 is an upright rigid reinforcement of the lower end portion of member 311 which inhibits bending and breaking of bar 307 and upright member 311 during the acceleration phase of impact of a motor vehicle on member 311 shown by arrow 309. When the motor vehicle front bumper impacts against member 311, shown by arrow 309, the entire sign and support frame 300 is raised and accelerated forward exerting substantial forces on the arch member 301, bar 307, and upright member 311. The arch members 301 tilt upwardly and engage the bottom of the automobile front bumper or front frame. Arch members 301 have middle sections located above support surface 306 that engage the front bumper to limit rearward tilting of the sign and support frame and reduce bending, breaking, and fragmentation of bar 307 and upright member 311.

There have been shown and described a sign and sign support frame and modifications of support frames for signs. Changes in structures and arrangement of structures and parts for these sign support frames may be made by persons skilled in the art without departing from the invention as defined in the following claims.

The invention claimed is:

1. A portable support for a highway sign that may be hit with a motor vehicle having a front bumper and a front frame comprising: a frame having a base member adapted to rest unsecured on a support surface for a motor vehicle and movably on the support surface when hit with a motor vehicle, said base member having a middle portion, a reinforcement bar extended upwardly from the middle portion of the base member, means securing the bar to the middle portion of the base member, an upright member adapted to be connected to a highway sign, said upright member having a section telescoped over the bar, means securing the upright member to the bar, said section of the upright member having a motor vehicle impact area, said bar having a length to reinforce said section of the upright member including the motor vehicle impact area of the upright member to inhibit bending and breaking of the upright member, a sleeve surrounding the outside of the section of the upright member to further reinforce the upright member, said sleeve having a motor vehicle impact area, an upwardly and rearwardly extended ramp secured to the base member and sleeve, said ramp being located below said motor vehicle impact area of the sleeve, said ramp engaging the bumper or front frame of the motor vehicle when the motor vehicle hits the motor vehicle impact area of the sleeve and upright member thereby limiting upward and rearward movements of the upright member and sign and reducing bending and breaking forces on the upright member and bar.

2. The support of claim 1 wherein: the ramp extends upwardly and rearwardly at an angle of at least 20 degrees relative to the base member.

3. The support of claim 1 including: a fastener securing the sleeve to the upright member.

4. The support of claim 1 wherein: the upright member is located in a plane perpendicular to the middle portion of the base member.

5. The support of claim 4 wherein: the base member has a length that is about twice the length of the ramp.

6. A highway sign and support for the sign that may be hit with a motor vehicle having a front bumper and a front frame comprising: a generally flat upright sign, a support for holding the sign in an upright position, said support comprising a first frame and a second frame laterally spaced from the first frame, each of said frames having a horizontal base member adapted to rest unsecured on a support surface for movement relative to said surface when the frame is hit with a motor vehicle, said base member having a forward end and a middle section, a ramp having a forward end joined to the forward end of the base member and a rear end, said ramp being inclined upwardly and rearwardly and located in the vertical plane of the base member, upright structure joined to the rear end of the ramp, and fasteners securing the sign to the upright structure of the first and second frames, said sign and fasteners being the only elements that retain the first and second frames in upright laterally spaced positions and support the sign in an upright position, said ramps engaging the bumper or front frame of the motor vehicle when the motor vehicle hits the frames thereby limiting upward and rearward movements of the upright structure and sign toward the motor vehicle.

7. The sign and support of claim 6 wherein: the fasteners include a plurality of connectors attaching each upright structure to the sign.

8. The sign and support of claim 6 wherein: the upright structure includes an upright member, said fasteners securing the upright member to the sign.

9. The sign and support of claim 8 wherein: the base member has a length that is about twice the length of the ramp.

10. The sign and support of claim 6 wherein: the upright structure is located in a plane perpendicular to the middle section of the base member.

11. The sign and support of claim 6 wherein: the ramp extends upwardly and rearwardly at an angle of at least 20 degrees relative to the base member.

* * * * *